US006853822B2

(12) United States Patent
Yano et al.

(10) Patent No.: US 6,853,822 B2
(45) Date of Patent: Feb. 8, 2005

(54) DEVICE FOR REMOVING IMAGE DISFIGURING SUBSTANCES AND IMAGE FORMING APPARATUS USING THE SAME

(75) Inventors: Hidetoshi Yano, Kanagawa (JP); Aino Noguchi, Kanagawa (JP); Hiromitsu Takagaki, Kanagawa (JP); Kiyoshi Tanikawa, Kanagawa (JP); Chiaki Tanaka, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 91 days.

(21) Appl. No.: 10/026,743

(22) Filed: Dec. 27, 2001

(65) Prior Publication Data

US 2002/0094214 A1 Jul. 18, 2002

(30) Foreign Application Priority Data

Dec. 28, 2000 (JP) ..... 2000-403395
Dec. 10, 2001 (JP) ..... 2001-376440

(51) Int. Cl.[7] ..... G03G 21/00

(52) U.S. Cl. ..... 399/127; 399/352; 399/353; 399/357

(58) Field of Search ..... 399/343, 346, 399/349, 352, 357, 353, 127

(56) References Cited

U.S. PATENT DOCUMENTS 3,975,096 A * 8/1976 Opravil ..... 399/352
4,101,215 A * 7/1978 Fottner et al. ..... 399/357
4,252,435 A * 2/1981 Manghirmalani, deceased ..... 399/357
4,656,966 A 4/1987 Guistina
5,241,343 A * 8/1993 Nishio ..... 399/357
5,332,642 A * 7/1994 Simms et al.
5,733,698 A * 3/1998 Lehman et al.
6,118,970 A * 9/2000 Suzuki et al. ..... 399/357
6,345,166 B1 * 2/2002 Sakaizawa et al. ..... 399/357
6,360,068 B1 3/2002 Kinoshita et al.
6,363,229 B1 3/2002 Shiraishi et al.
6,395,443 B2 5/2002 Kuroda et al.
6,403,275 B1 6/2002 Kuramoto et al.
6,468,706 B2 10/2002 Matsuda et al.
6,492,079 B2 12/2002 Shimada et al.
6,500,536 B1 12/2002 Yamada et al.

FOREIGN PATENT DOCUMENTS

JP 57167067 A * 10/1982 ..... G03G/21/00
JP 60-49352 3/1985
JP 61-6678 1/1986
JP 01314278 A * 12/1989 ..... G03G/21/00
JP 2-208685 8/1990
JP 04287081 A * 10/1992 ..... G03G/21/00
JP 4-287081 12/1992
JP 8-248820 9/1996
JP 9-305083 11/1997
JP 2001-22140 1/2001
JP 2002099189 A * 4/2002 ..... G03G/21/00
JP 2003241467 A * 8/2003 ..... G03G/15/00

OTHER PUBLICATIONS

U.S. Appl. No. 10/112,769, filed Apr. 2, 2002, pending.

(List continued on next page.)

*Primary Examiner*—Susan Lee
(74) *Attorney, Agent, or Firm*—Oblon, Spivak, McClelland, Maier & Neustadt, P.C.

(57) ABSTRACT

A device included in an image forming apparatus for removing a substance that disfigures an image. The device includes an adsorbent support that supports an adsorbent. The absorbent has a molecular structure including voids that have a diameter great enough to pass molecules of the disfiguring substance which is deposited on the surface of an image carrier and contain water.

90 Claims, 20 Drawing Sheets

OTHER PUBLICATIONS

U.S. Appl. No. 10/118,049, filed Jul. 3, 2002, pending.
U.S. Appl. No. 10/118,753, filed Jul. 5, 2002, pending.
U.S. Appl. No. 10/092,920, filed Mar. 8, 2002, pending.
U.S. Appl. No. 10/098,556, filed Mar. 18, 2002, pending.
U.S. Appl. No. 09/986,023, filed Nov. 7, 2001, pending.
U.S. Appl. No. 09/843,357, filed Apr. 26, 2001.
U.S. Appl. No. 09/826,789, filed Apr. 5, 2001.
U.S. Appl. No. 09/891,652, filed Jun. 26, 2001.
U.S. Appl. No. 09/897,924, filed Jul. 5, 2001, pending.
U.S. Appl. No. 09/814,622, filed Mar. 23, 2001, allowed.
U.S. Appl. No. 09/643,910, filed Aug. 23, 2000.
U.S. Appl. No. 09/712,927, filed Nov. 16, 2000.
U.S. Appl. No. 10/193,216, Jul. 12, 2002, pending.
U.S. Appl. No. 10/247,639, filed Sep. 20, 2002, pending.
U.S. Appl. No. 10/734,292, filed Dec. 15, 2003, Takeuchi et al.
U.S. Appl. No. 10/872,640, filed Jun. 22, 2004, Matsuoka et al.

* cited by examiner

DEVICE FOR REMOVING IMAGE DISFIGURING SUBSTANCES AND IMAGE FORMING APPARATUS USING THE SAME

BACKGROUND OF THE INVENTION

1. Field of the Invention

The present invention relates to a copier, facsimile apparatus, printer or similar image forming apparatus and more particularly to a device for removing substances that disfigure an image and an image forming apparatus using the same.

2. Description of the Background Art

Generally, an image forming apparatus includes a charging device for charging an image carrier by discharge during image formation. Products resulting from the discharge deposit on the surface of the image carrier. When the amount of the products increases, the products absorb water in the air in a humid environment and decreases in resistance to thereby lower the resistance of the surface of the image carrier. As a result, an image formed on the image carrier is sometimes blurred, partly lost or otherwise disfigured. This problem will be solved if the image carrier is provided with a surface easy to wear and if a cleaning blade or similar member is pressed against the image carrier for shaving off the surface by a relatively great amount together with the disfiguring products deposited thereon. Such a scheme, however, reduces the life of the image carrier.

A device for removing the disfiguring substances from the image carrier while maintaining the expected life of the image carrier has been proposed in various forms in the past. Japanese Patent Laid-Open Publication No. 60-49352, for example, discloses a disfiguring substance removing device including a water applying member for applying water to the surface of the image carrier and a water removing member for removing the former from the latter. This device is configured to effectively remove disfiguring substances by paying attention to the fact that the substances are water-soluble.

However, the surface of the image carrier is generally hydrophobic and causes water applied thereto to form scattered drops. It follows that even if the disfiguring substances dissolve in water on the surface of the image carrier, the aqueous solution containing the substances sparsely deposit on the surface in the form of drops. When such drops sparsely distributed on the surface of the image carrier are wiped off, the removing effect differs from portions where the drops are present to portions where they are absent. The resulting surface characteristic of the image carrier is apt to be irregular.

Technologies relating to the present invention are also disclosed in, e.g., Japanese Patent Laid-Open Publication Nos. 8-248820, 9-305083 and 2001-22140.

SUMMARY OF THE INVENTION

It is an object of the present invention to provide a disfiguring substance removing device capable of obviating or reducing defective images while solving the problem of the conventional device, and an image forming apparatus using the same.

In accordance with the present invention, a device for removing a substance that disfigures an image includes an adsorbent support supporting an adsorbent. The absorbent has a molecular structure including voids that have a diameter great enough to pass molecules of the disfiguring substance, which is deposited on the surface of an image carrier, therethrough and contain water therein.

An image forming apparatus using the above-described device is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, reference will be made to some different image forming apparatuses to which the present invention is applicable.

Figure 1:
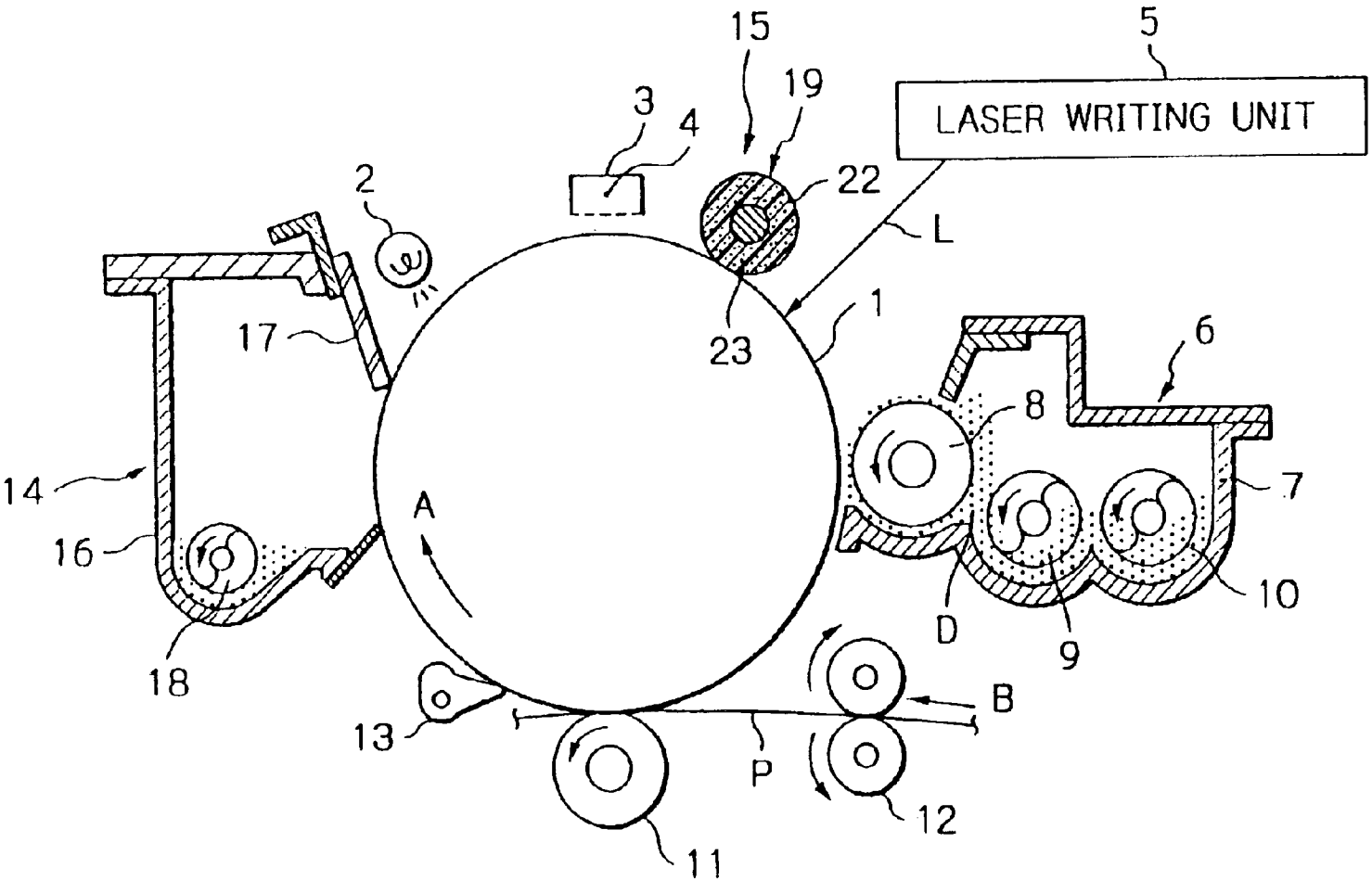
FIG. 1 is a section showing a conventional image forming apparatus to which the present invention is applicable.

FIG. 1 shows an image forming apparatus including a photoconductive element or image carrier implemented as a drum 1. On the start of image forming operation, the drum 1 is rotated clockwise, as viewed in FIG. 1, as indicated by an arrow A. A discharge lamp 2 discharges the surface of the drum 1 with light to thereby initialize the surface potential of the drum 1. A charger 3 includes a corona wire 4 to which a charging voltage is applied. The charger 3 uniformly charges the discharged surface of the drum 1 to preselected polarity, e.g., −900 V with the discharge of the corona wire 4.

The drum 1 may be replaced with an endless photoconductive belt passed over a plurality of rollers or with a dielectric image carrier. In any case, the image carrier is supported such that its surface is movable.

A laser writing unit 5, which is a specific form of latent image forming means, scans the charged surface of the drum 1 with a laser beam L in accordance with image data, thereby forming a latent image on the drum 1. More specifically, the surface potential of the drum 1 varies from −900 V to, e.g., −150 V in the portions scanned by the laser beam L, forming the latent image. The other portions of the drum 1 not scanned by the laser beam L maintain the potential of substantially −900 V, forming a background. The laser writing unit 5 may be replaced with an LED (Light Emitting Diode) array, if desired.

A developing unit 6 develops the latent image conveyed thereto by the drum 1. Specifically, the developing unit 6 includes a casing 7 storing a dry, two-ingredient type developer, i.e., a toner and carrier mixture D. A developing roller 8 is rotatable while facing the drum 1. Screws 9 and 10 are rotatable to agitate the developer D. Toner is charged to preselected polarity, e.g., negative polarity by friction acting between it and carrier. The developer D including the charged toner deposits on the developing roller 8. The developing roller 8 in rotation conveys the developer D to a developing position between it and the drum 1. A preselected bias for development, e.g., −600 V is applied to the developing roller 8. As a result, the toner of the developer forming a magnet brush on the developing roller 8 is electrically transferred from the roller 8 to the latent image carried on the drum 1, developing the latent image to thereby produce a toner image. The toner and carrier mixture may be replaced with toner only or a developing liquid.

An image transfer roller, which is a specific form of an image transferring device, is rotatable counterclockwise, as viewed in FIG. 1, in contact with the drum 1. A registration roller pair 12 conveys, at preselected timing, a sheet P fed from a sheet feed section, not shown, toward a nip between the image transfer roller 11 and the drum 1 in a direction indicated by an arrow B. At this instant, the image transfer roller 11 is charged to polarity opposite to the polarity of the toner image, i.e., to positive polarity. Consequently, the toner image is transferred from the drum 1 to the sheet P.

A peeler 13 peels the sheet P off the drum 1. The sheet P is then conveyed to a fixing unit not shown. The fixing unit fixes the toner image on the sheet P with heat and pressure. Finally, the sheet or print P is driven out of the apparatus body. The image transfer roller 11 may be replaced with a charger, a brush, a blade or a combination of any of them and a belt.

The sheet P is implemented as, e.g., a paper sheet, a resin sheet or a resin film. The apparatus may additionally include an intermediate image transfer body in the form of an endless belt or a drum. In such a case, the toner image will be transferred to the intermediate image transfer body (primary transfer) and then to the sheet P (secondary transfer).

A cleaning unit 14 removes the toner left on the drum 1 after the image transfer. The cleaning unit 14 includes a casing 16, a cleaning blade 17, and a screw 18. The cleaning blade 17 has a base portion supported by the casing 16 and an edge formed of rubber or similar elastic material and pressed against the drum 1. The cleaning blade 17 scrapes off the toner left on the drum 1. The screw 18 conveys the toner removed by the cleaning blade 17 to the outside of the casing 16. The cleaning blade 17 is a specific form of cleaning means.

In FIG. 1, the reference numeral 15 designates a disfiguring substance removing device embodying the present invention that will be described specifically later.

The charger 3 with the corona wire 4 is spaced from the surface of the drum 1. The charger 3 may be replaced with any other suitable charging device, e.g., a charge roller, a charge blade, a charge brush or even a charging device that injects charge in the image carrier.

Figure 2:
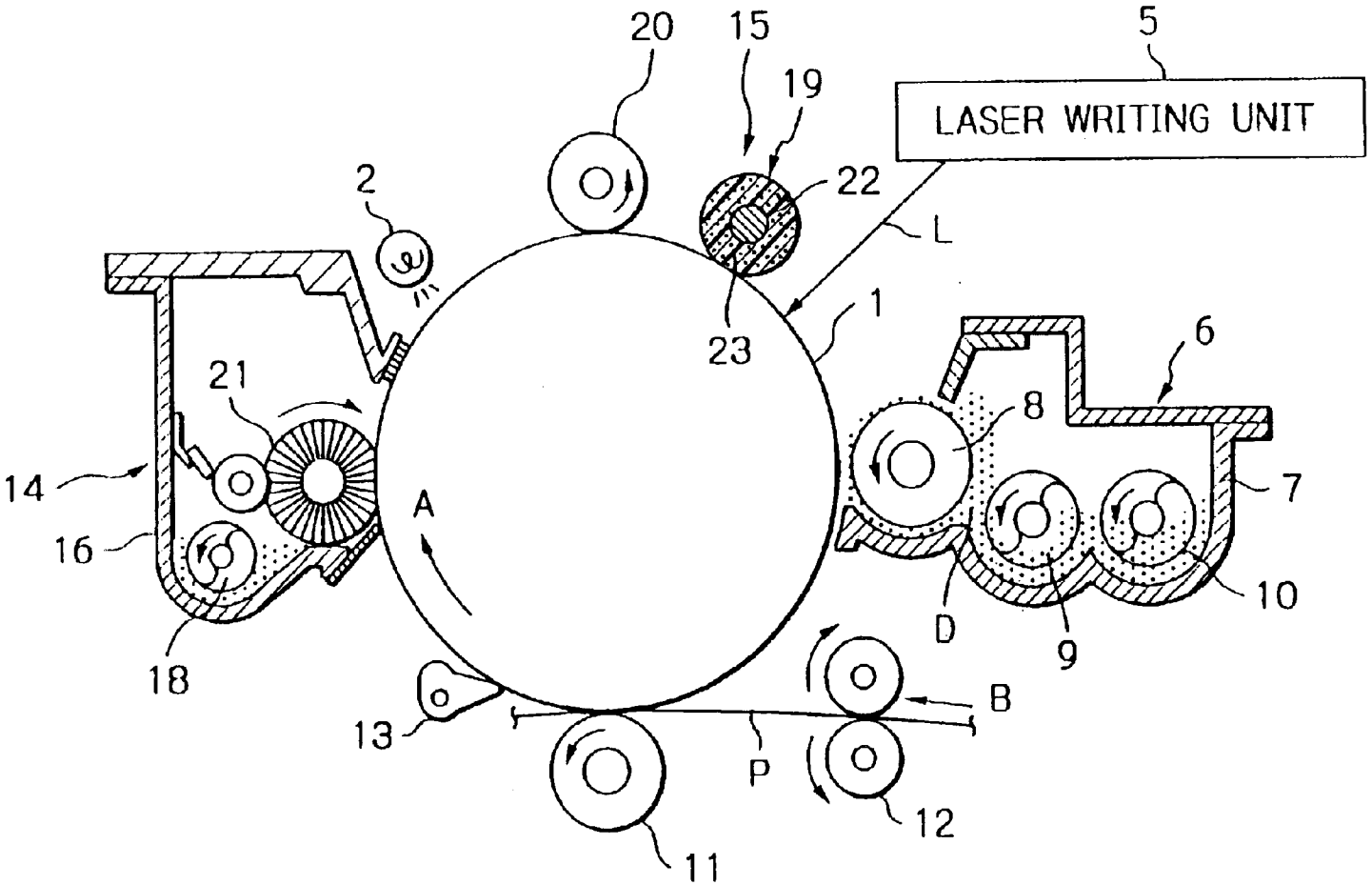
FIG. 2 is a section showing another conventional image forming apparatus to which the present invention is applicable.

FIG. 2 shows another specific image forming apparatus in which the charging device is implemented as a charge roller 20 contacting or slightly spaced from the drum or image carrier 1. An AC-biased DC voltage is applied to the charge roller 20. The charge roller 20 uniformly charges the surface of the drum 1 to, e.g., −900 V by discharge. The cleaning means is implemented as a brush 21 rotatable in contact with the drum 1. As for the rest of the construction, the apparatus of FIG. 2 is identical with the apparatus of FIG. 1.

Figure 3:
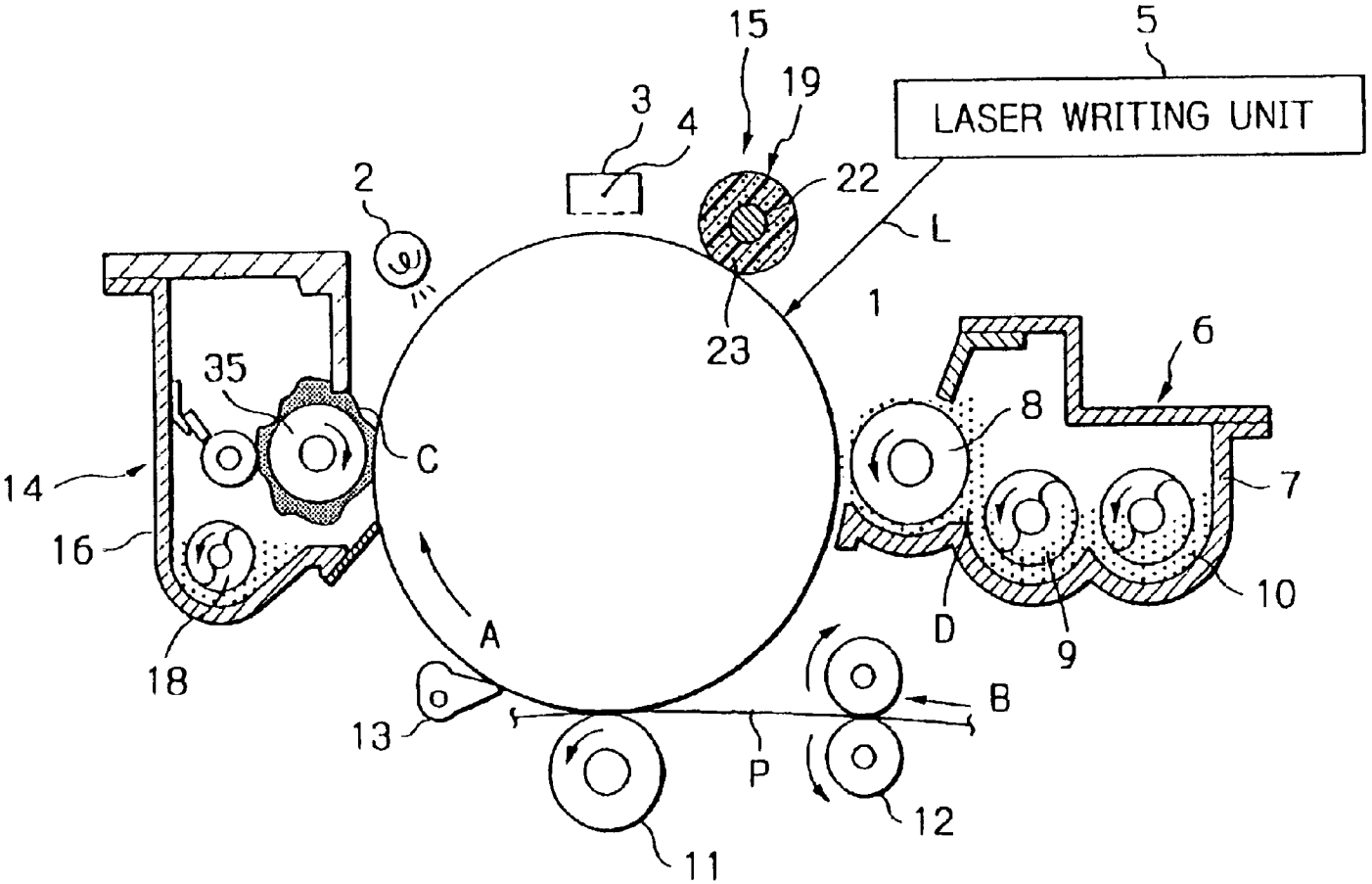
FIG. 3 is a section showing a further conventional image forming apparatus to which the present invention is applicable.

FIG. 3 shows still another specific image forming apparatus including a rotatable roller 35 as part of cleaning means. A cleaning agent C, which is a toner and magnetic carrier mixture, is magnetically deposited on the roller 35 and forms the other part of the cleaning means. The cleaning agent C is held in sliding contact with the surface of the drum 1 in order to remove the toner left on the drum 1. As for the rest of the construction, the apparatus of FIG. 3 is also identical with the apparatus of FIG. 1.

The various cleaning means described above may be used in combination, if desired.

As stated above, the essential features of an image forming apparatus to which the present invention is applicable are as follows:

- image carrier
- charging device for charging the image carrier
- latent image forming means for forming a latent image on the charged surface of the image carrier
- developing unit for developing the latent image to thereby produce a corresponding toner image
- cleaning unit for removing toner left on the image carrier after image transfer In the apparatus shown in FIG. 1, for example, a preselected voltage is applied to the corona wire 4 of the charger 3, so that the resulting discharge charges the drum 1. At this instant, products resulting from the discharge are combined with substances present in, e.g., the air to produce disfiguring substances. The disfiguring substances deposit on the surface of the drum 1. This is also true when any other charging device, e.g., the charge roller 20 of FIG. 2 is used.

We conducted a series of researches and experiments to find that ammonium nitrate was the major disfiguring substance to deposit on the image carrier. Presumably, ammonium nitrate is produced by the following mechanism. First, $NO_2$ and water ($H_2O$) react with each other to produce nitric acid ($NHO_3$). Subsequently, $NHO_3$ reacts with ammonia gas ($NH_3$) present in the air to produce ammonium nitrate ($NH_4NO_3$). Such reaction steps are formulated as:

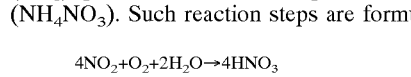

$$4NO_2+O_2+2H_2O \rightarrow 4HNO_3$$

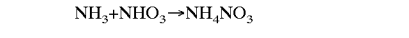

$$NH_3+NHO_3 \rightarrow NH_4NO_3$$

Presumably, most of ammonium nitrate or disfiguring substance is generated in the air in the form of minute particles, and then ammonium nitrate produced in the vicinity of the image carrier deposits on the image carrier. The disfiguring substance on the image carrier, which is water-soluble, absorbs water in the air in a humid environment and thereby lowers the resistance of the surface of the image carrier. It follows that when the disfiguring substance extends over the latent image and background in a great amount and is not removed, it blurs an image or causes it to be partly lost in a humid environment.

If the cleaning blade is so configured as to wear the surface of the image carrier surface by a relatively great amount, then the disfiguring substance will also be removed from the above surface, obviating defective images. This, however, reduces the life of the image carrier. More specifically, to extend the life of the image carrier, it is necessary to provide the image carrier with a hard surface or to lower pressure to act between the cleaning blade and the image carrier to one that does not excessively reduce the toner removing efficiency. Such a scheme, however, prevents the disfiguring substance deposited on the image carrier from being fully removed and therefore results in defective images. This is also true with the brush 21, FIG. 2, pressing the image carrier with lower pressure than the blade 17, FIG. 1, and with the cleaning means using the cleaning agent C, FIG. 3.

The disfiguring substance removing device 15 embodying the present invention removes the disfiguring substance from the image carrier while reducing the wear of the image carrier or reduces defective images even when the image carrier is so configured as not to be shaved.

Figure 4:
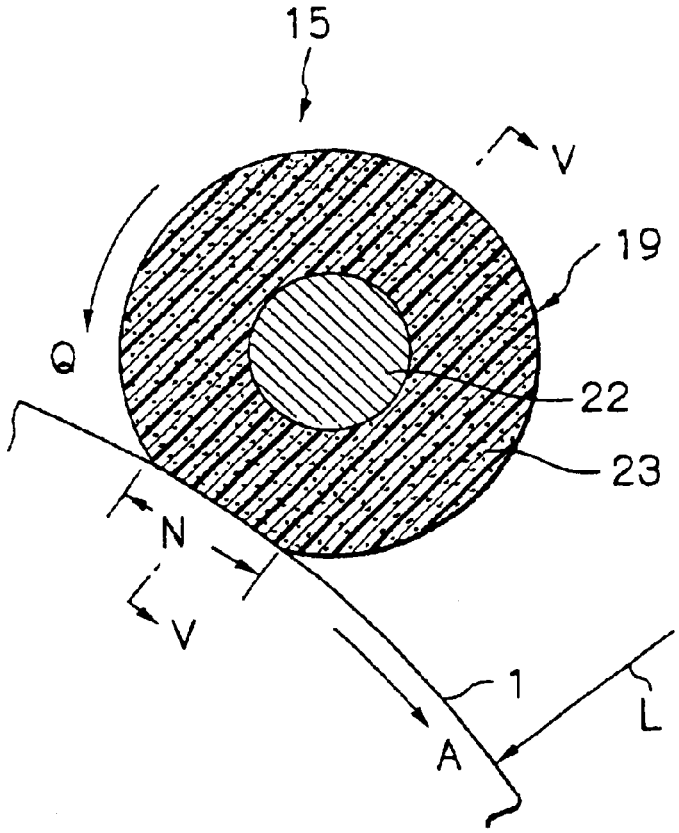
FIG. 4 is an enlarged section showing a specific configuration of an adsorbent support included in any one of the image forming apparatuses shown in FIGS. 1 through 3.
Figure 5:
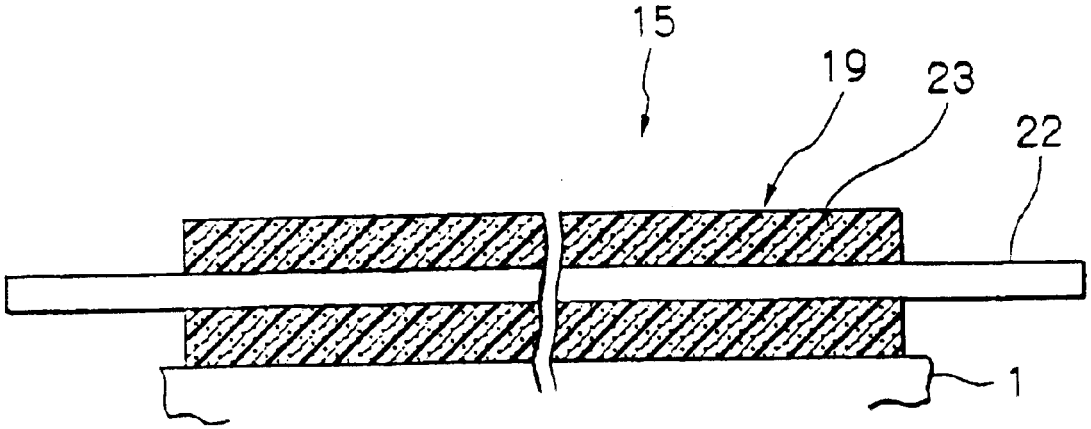
FIG. 5 is a section along line V—V of FIG. 4.

FIGS. 4 and 5 show a specific configuration of the disfiguring substance removing device 15 in detail. As shown, the device 15 includes an adsorbent support 19 supporting an adsorbent that adsorbs the disfiguring substance, which is deposited on the drum 1. The adsorbent support 19 and therefore the adsorbent is held in contact with the drum 1.

As for molecular structure, the adsorbent applicable to the illustrative embodiment has voids having a diameter great enough for the molecules of the disfiguring substance to pass and containing water therein. Use may be made of zeolite by way of example. Generally, in a zeolite crystal, the large voids of condensed anions having the three-dimensional frame structure of aminosilicate contain cations interchangeable with water. A zeolite crystal has various structures, depending on the kind and number of cations. Zeolite therefore has a molecular sieving function and a reversible ion exchanging function derived from the ring structure of voids formed by oxygen. In addition, zeolight has a function of adsorbing and separating dipole, tetrapole, unsaturated bond substances and highly polarizable substances. Further, zeolight allows a substance to migrate in an electronic potential energy field formed in the void constituting a crystal (dispersion in void). Even 3A type zeolite whose void diameter is about 3 Å, which is smallest at the present stage of development, can adsorb water (drying function) and can adsorb hydrogen and methanol. Molecular Sieve (trade name), which is one type of zeolite, has cations in a crystal and exhibits affinity to polar molecules derived from the electrostatic attraction of the cations more than to activated alumina or silica gel (ion affinity). Moreover, Molecular Sieve has a catalytic function that causes various chemical reactions to occur.

Zeolite having the functions described above is supported by a brush, paper, cloth, felt, plastics or rubber and then configured as a roller, a sheet, a plate, a stick or a honeycomb. By holding such a member with zeolite in contact with the surface of an image carrier, it is possible to effective remove the disfiguring substance that brings about defective images.

Why zeolite is effective to remove the disfiguring substance is presumably as follows. Typical of molecular formula of zeolite is:

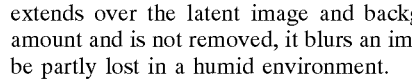

$$(M^{I},M^{II}_{0.5})_m(Al_mSi_nO_{2(m+1)}).xH_2O$$

Figure 6:
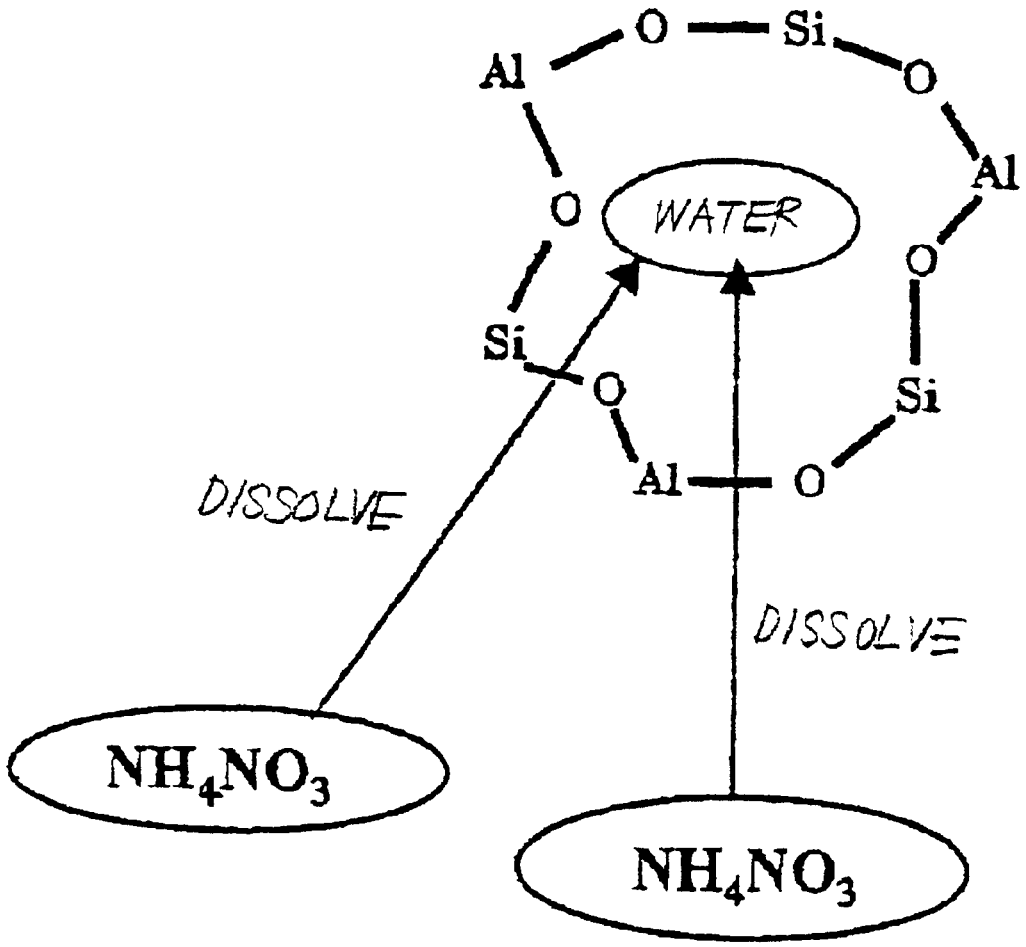
FIG. 6 is a view demonstrating how ammonium nitrate dissolves in the void of zeolite.
Figure 7:
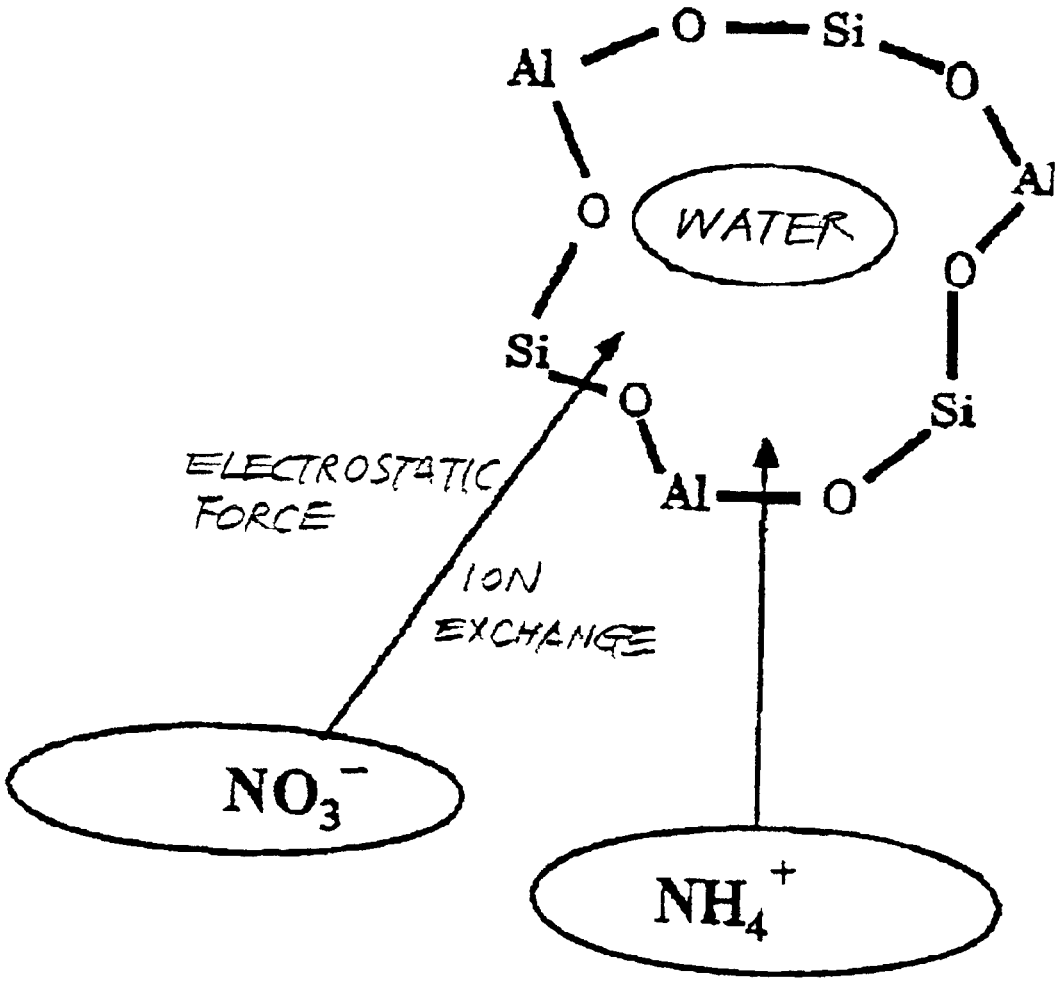
FIG. 7 is a view demonstrating how ionized substances are electrostatically adsorbed in the void of zeolite.
Figure 8:
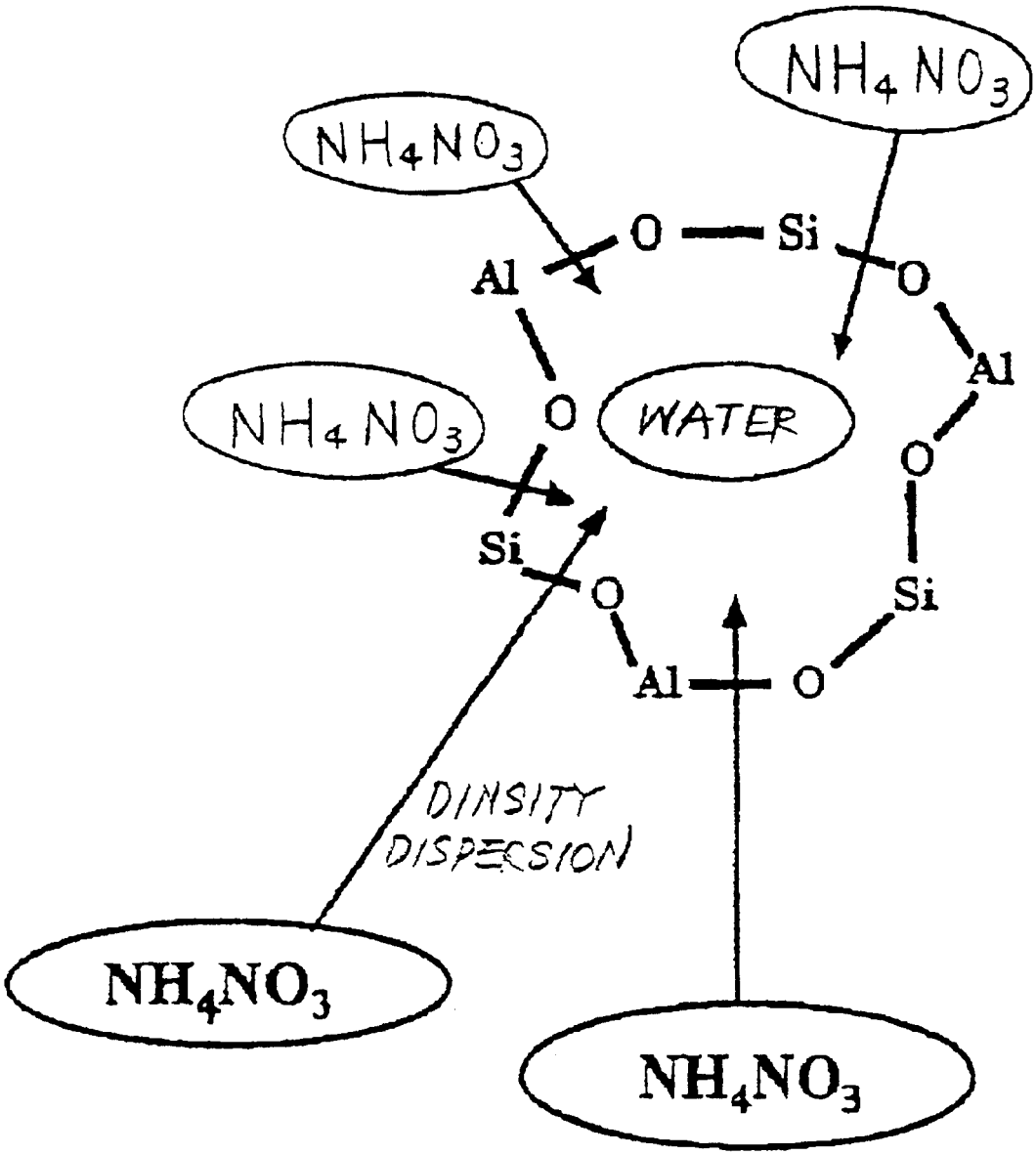
FIG. 8 is a view showing how ammonium nitrate is adsorbed in the void of zeolite due to density difference.

FIGS. 6 through 8 demonstrate specific bonds of atoms in the void of zeolite. Water exists in the void of zeolite because the void takes in water during production or takes in water around the disfiguring substance removing device. On the other hand, ammonium nitrate deposited on the image carrier is water-soluble, and the void has a diameter great enough to pass an ammonium nitrate molecule. Therefore, as shown in FIG. 6, ammonium nitrate dissolves in and therefore adsorbed by water present in the void of zeolite, which is held in contact with the image carrier. $HNO_3$ gas and $HN_3$ gas also dissolve in water in the void.

Zeolite has traditionally been used as a desiccant. The desiccant, however adsorbs water in the voids of zeolite from which water has been removed beforehand. By contrast, the disfiguring substance removing device of the present invention positively uses water present in the voids of zeolite and causes it to adsorb the disfiguring substance for thereby holding the substance in the voids. As shown in FIG. 7, ammonium nitrate adsorbed water present in the air is ionized and then electrostatically retained in the void of zeolite. In this condition, zeolite electrostatically adsorbs the disfiguring substance deposited on the image carrier.

Further, as shown in FIG. 8, ammonium nitrate is more dense inside of the void of zeolite than outside of the same. Consequently, ammonium nitrate deposited on the image carrier migrates into the void. This is also successful to remove the disfiguring substance from the image carrier.

FIGS. 6 through 8 model the adsorption of the disfiguring substance by zeolite. In practice, the phenomena shown in FIGS. 6 through 8 presumably occur at the same time to thereby remove the disfiguring substance from the image carrier.

Substances other than ammonium nitrate may also bring about defective images, so that the absorbent should preferably have a void diameter great enough to pass the molecules of such substances as well. However, because ammonium nitrate presumably is the major disfiguring substance, the adsorbent capable of passing ammonium nitrate molecule through its voids can efficiently remove the disfiguring substance from the image carrier. Zeolite has three, four, five, six, eight, ten, twelve or eighteen oxygen rings and can be used as the adsorbent without regard to the number of oxygen rings. Zeolite having eight or more oxygen rings is particularly desirable because of a large void diameter.

The adsorbent support may support the adsorbent in any desired manner. For example, the adsorbent may be adhered to the adsorbent support. Alternatively, the adsorbent may be implemented as grains and releasably deposited on the adsorbent support. Further, such configurations may be used in combination.

The disfiguring substance removing device 15 can remove the entire or part of the disfiguring substance deposited on the drum or image carrier 1. This successfully obviates or reduces defective images and thereby insures high image quality. Furthermore, water that is apt to make the surface characteristic of the drum 1 irregular after the removal, as stated earlier, does not have to be applied to the drum 1.

The adsorbent support may be implemented as a sheet, a roller, a plate or a stick by way of example. In FIGS. 1 through 5, the adsorbent support 19 is made up of a core 22 formed of metal or similar rigid material and an elastic body 23 coaxially surrounding the core 22. The elastic body 23 has a hollow cylindrical configuration. The adsorbent implemented by zeolite is affixed to the outer circumference of the elastic body 23. The core 22 has its opposite ends supported by a frame not shown. The elastic member 23 is pressed against the surface of the drum 1. The adsorbent support 19 and frame supporting it constitute the device 15, which is a single unit.

In the condition described above, the elastic body 23 contacts the surface of the drum 1 over a certain width N in the circumferential direction. The adsorbent support 19 therefore contacts the drum 1 uniformly over a broad area and can uniformly remove the disfiguring substance. The elastic body 23 should preferably be formed of a soft material, e.g., rubber, soft resin or foam thereof, e.g., foam polyurethane.

Figure 9:
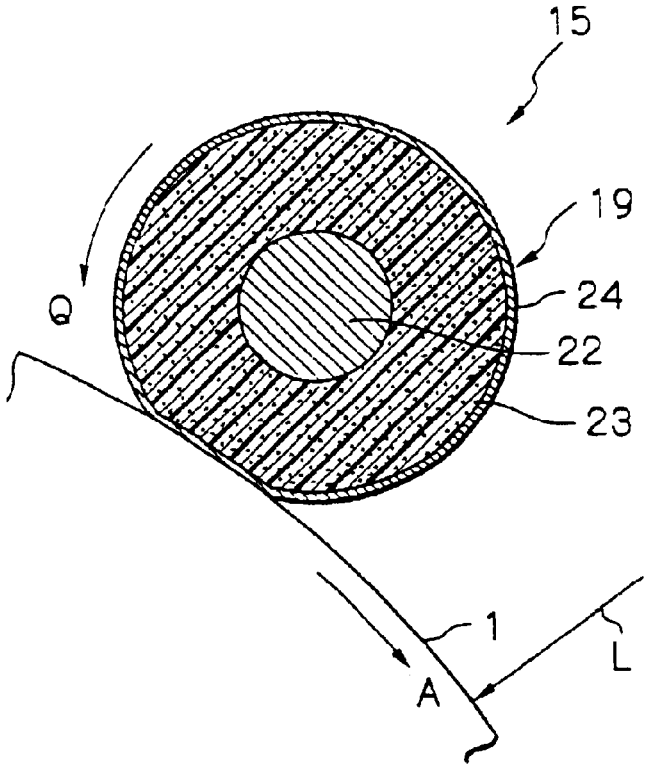
FIG. 9 is a view similar to FIG. 4, showing another specific configuration of the adsorbent support.
Figure 10:
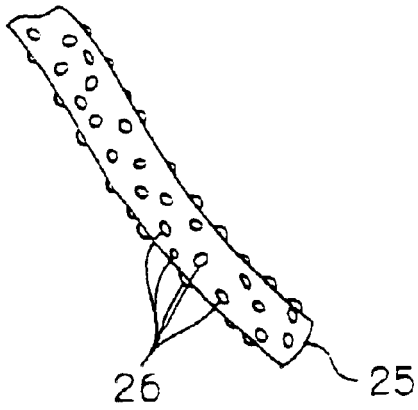
FIG. 10 is a view showing zeolite affixed to cellulose fibers.

FIG. 9 shows another specific configuration of the disfiguring substance removing device 15. As shown, a surface layer 24 is wrapped around and affixed to the elastic body 23. The absorbent implemented by zeolite is affixed to the circumference of the surface layer 24 and held in contact with the drum 1. The surface layer 24 is implemented as a sheet of rubber, paper, cloth, resin or similar material. FIG. 10 shows a specific configuration in which zeolite crystals 26 are affixed to the cellulose fibers 25 of paper.

The above modification achieves the following advantage in addition to the advantages described with reference to FIGS. 4 and 5. When the adsorbent is deteriorated, the surface layer 24 is removed from the elastic body 23, and then a new surface layer 24 is wrapped around the elastic member 23. This allows the core 22 and elastic member 23 to be repeatedly used over a long time and therefore reduces the amount of wastes.

Figure 11:
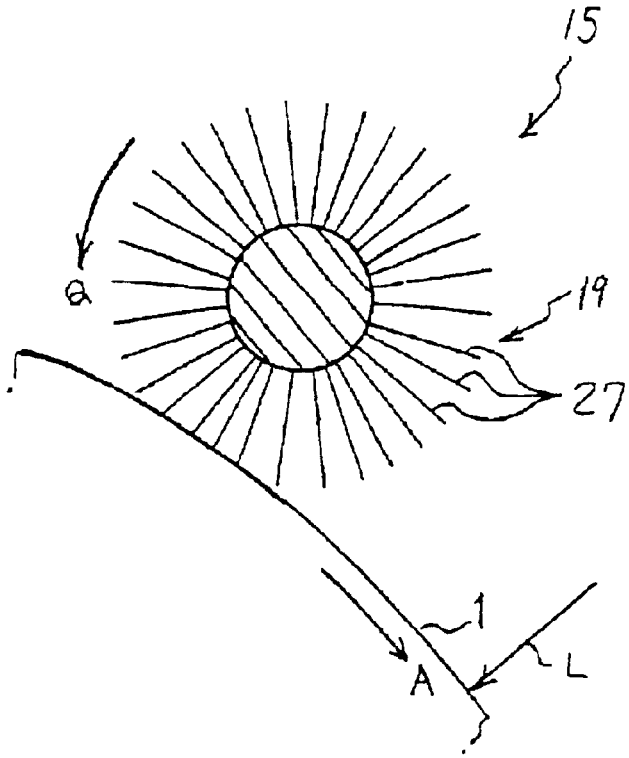
FIG. 11 is a view showing a disfiguring substance removing device including the adsorbent support implemented as a brush.

FIG. 11 shows another specific configuration of the disfiguring substance removing device 15. As shown, the absorbent support 19 includes a brush 27 implemented by a number of bristles on which the absorbent or zeolite is affixed. The brush 27 and therefore the bristles are held in contact with the drum 1. The shaft of the brush 27 is supported by a frame, not shown, at opposite ends thereof. Zeolite crystals may be deposited on the bristles of the brush 27 in the same manner as described with reference to FIG. 10. The brush 27 causes a minimum of friction to act between it and the drum 1 and thereby reduces a load on the drum 1. This successfully reduces power necessary for rotating the drum 1 and frees the drum 1 from irregular rotation to thereby free the toner image from irregular density in the form of stripes.

Figure 12:
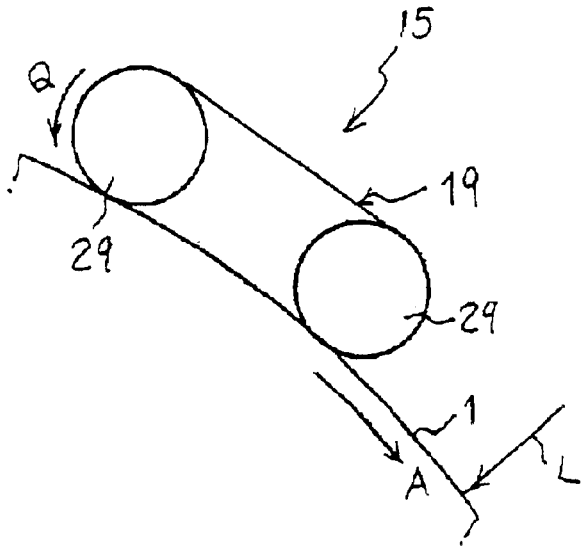
FIG. 12 is a view showing a disfiguring substance removing device including the adsorbent support implemented as an endless belt.

FIG. 12 shows still another configuration of the disfiguring substance removing device 15. As shown, the adsorbent support 19 is implemented as an endless belt passed over rollers or similar support members 29. The adsorbent is affixed to the outer surface of the belt 19 and held in contact with the drum 1. The device 15 shown in FIG. 12 allows the adsorbent support 19 to uniformly contact the drum 1. In addition, the device 15 increases the area over which the adsorbent support 19 and drum 1 contact each other, thereby further promoting the uniform, effective removal of the disfiguring substance from the drum 1.

While the adsorbent support 19 shown in any one of FIGS. 4, 5, 9, 11 and 12 may not be rotatable, it may be rotatably supported by a frame, not shown, and driven by the surface of the drum 1. The rotatable adsorbent support 19 contacts the surface of the drum 1 over its entire circumference and is therefore long life. If the adsorbent support 19 is freely rotatably supported and driven by the drum 1 in a direction Q, then an exclusive driveline for the support 19 that would increase the cost is not needless.

Conversely, assume that a drive source, not shown, causes the absorbent support 19 to rotate. Then, the linear velocity of the adsorbent support 19 and that of the drum 1 should preferably be different from each other in order to enhance friction between the drum 1 and the support 19. This promotes more efficient removal of the disfiguring substance from the drum 1.

Figure 13:
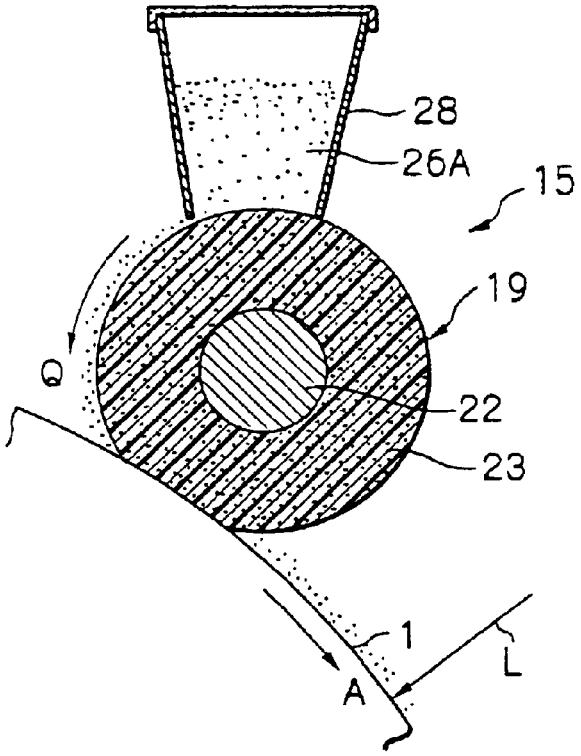
FIG. 13 is a view showing a specific configuration in which adsorbent grains are deposited on the adsorbent support.

The adsorbent may be removably deposited on the adsorbent support 19 in the form of grains, as will be described hereinafter. FIG. 13 shows the rotatable adsorbent support 19 of FIGS. 4 and 5 and a hopper 28 positioned above the adsorbent support 19. The hopper 28 stores adsorbent grains 26A. While the adsorbent support 19 is rotated in the direction Q, the adsorbent grains 26A are fed from the hopper 28 to the support 19 little by little. The elastic body 23 rotates in contact with the drum 1 while carrying the adsorbent grains 26A thereon. As a result, the adsorbent grains 26A are deposited on the drum 1.

Figure 14:
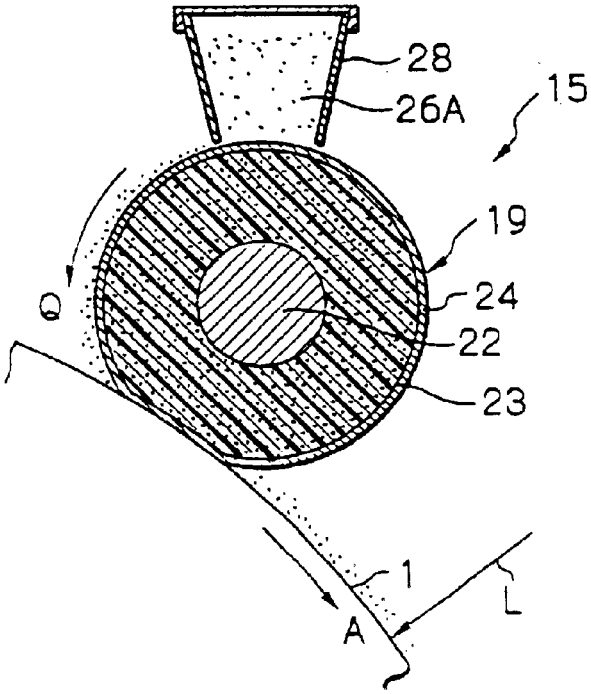
FIG. 14 is a view showing another specific configuration in which adsorbent grains are deposited on the adsorbent support.
Figure 15:
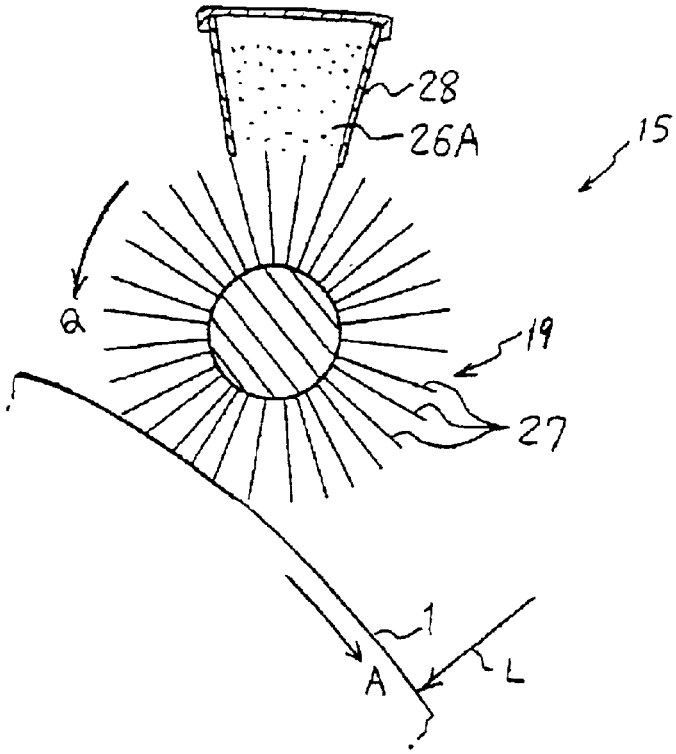
FIG. 15 is a view showing still another specific configuration in which adsorbent grains are deposited on the adsorbent support.
Figure 16:
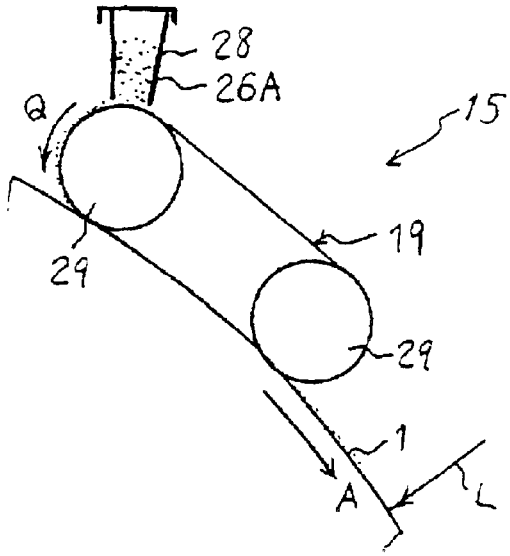
FIG. 16 is a view showing a further specific configuration in which adsorbent grains are deposited on the adsorbent support.

FIG. 14 shows the hopper 28 storing the adsorbent grains 26A applied to the rotatable adsorbent support 19 described with reference to FIG. 9. In this case, the adsorbent grains 26A deposit on the surface layer 24 of the adsorbent support 19. FIG. 15 shows the hopper 28 storing the adsorbent grains 26A applied to the rotatable brush 27 shown in FIG. 11; the grains 26A deposit on the brush 27. Further, FIG. 16 shows the hopper 28 storing the adsorbent grains 26A applied to the belt-like adsorbent support 19 shown in FIG. 12; the grains 26A deposit on the belt 19.

The configurations shown in FIGS. 13 through 16 each feed the absorbent grains 26A to the surface of the drum 1 and can therefore efficiently remove the disfiguring substance from the above surface. The adsorbent support 19 shown in any one of FIGS. 13 through 16 may also be configured to be driven by the surface of the drum 1 in order to achieve the previously described advantages.

The disfiguring substance removing device 15, which includes at least the adsorbent support 19, may be removably mounted to the apparatus of an image forming apparatus. If desired, the image carrier, disfiguring substance removing device and at least one of the charging device, developing device, image transferring device and cleaning device may be constructed into a single process cartridge, which is removably mounted to the apparatus body.

We found by extended researches and experiments that the nitrate compound deposited on the surface of the image carrier increased the coefficient of friction of the surface and further reduced the life of the image carrier. This fact worth notice will be described more specifically to facilitate an understanding of the present invention.

Figure 17:
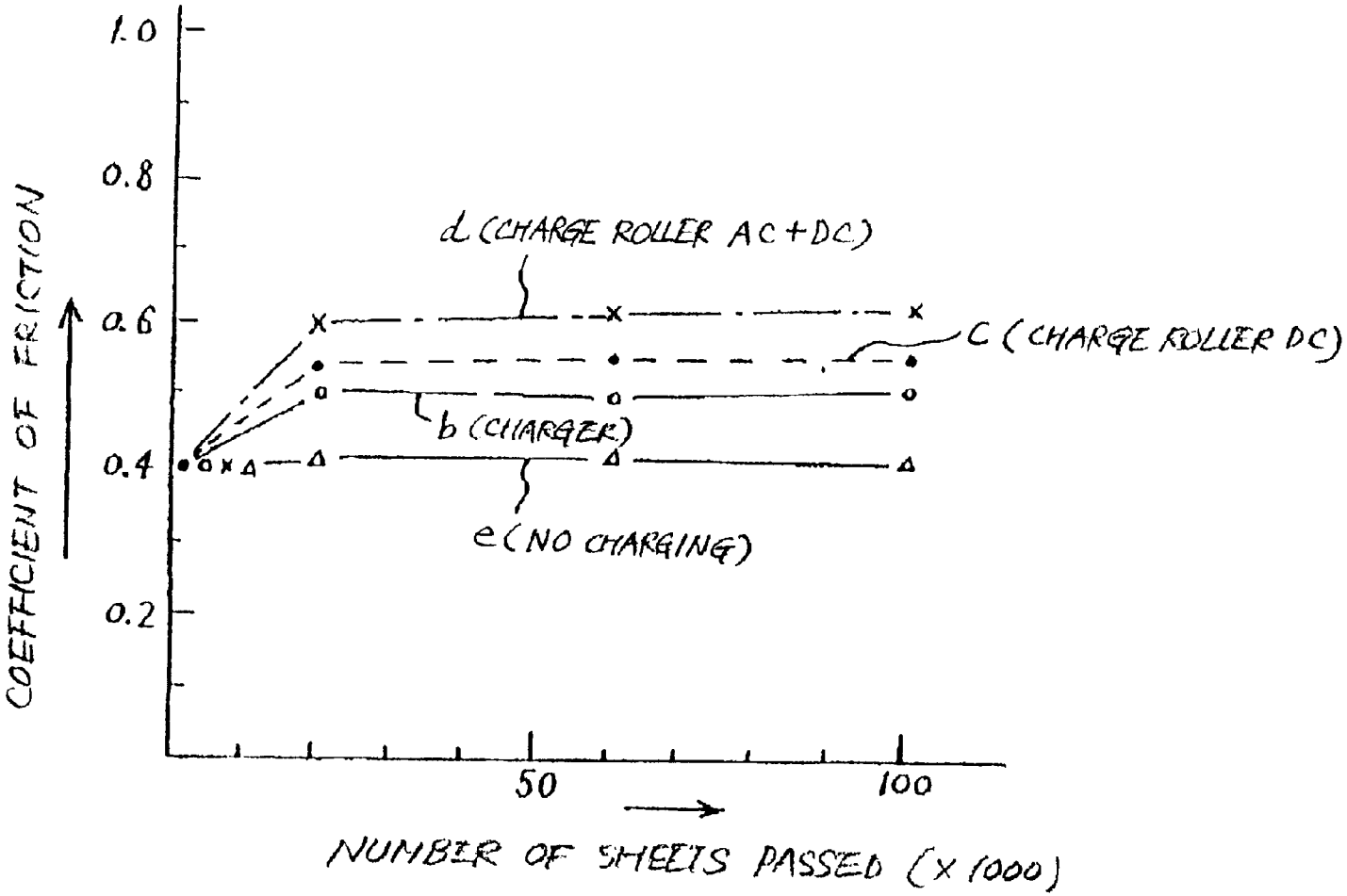
FIG. 17 is a graph showing a specific relation between the number of sheets passed and the coefficient of friction of the surface of an image carrier.

FIG. 17 shows a relation between the number of sheets and the coefficient of friction of the surface of the image carrier determined by experiments. The relation was determined when the image carrier was implemented as a drum having a diameter of 30 mm and driven at a linear velocity of 114 mm/sec and when sheets of size A4 were conveyed in a long edge feed position, i.e., with long edges being positioned perpendicular to the direction of sheet conveyance. The adsorbent support 19 was removed for the experiments. The coefficient of friction was measured and calculated by an Euler belt system. This is also true with the coefficient of friction that will be describe with reference to FIG. 20 later.

In FIG. 17, a curve a shows experimental results obtained when the charging device did not charge the image carrier and when the cleaning blade 17, FIG. 1, was pressed against the image carrier. Curves b, c and d show experimental results obtained when the charging device charged the image carrier, but the cleaning unit was removed so as not to clean the image carrier. More specifically, as for the curve b, the charger 3, FIG. 3, charged the image carrier while, as for the curve c, the charge roller 20, FIG. 2, charged the image carrier with a DC voltage applied thereto. Further, as for the curve d, the charge roller 20 charged the image carrier with an DC-biased AC voltage applied thereto.

As the curve a indicates, when no disfiguring substance deposits on the image carrier, the coefficient of friction of the image carrier remains substantially constant without regard to the number of sheets passed. By contrast, as the curves b, c and d indicate, the disfiguring substance deposited on the image carrier due to discharge increases the coefficient of friction in the order of charge roller 3, charge roller (DC) 20, and charge roller (AC+DC) 20.

Figure 18:
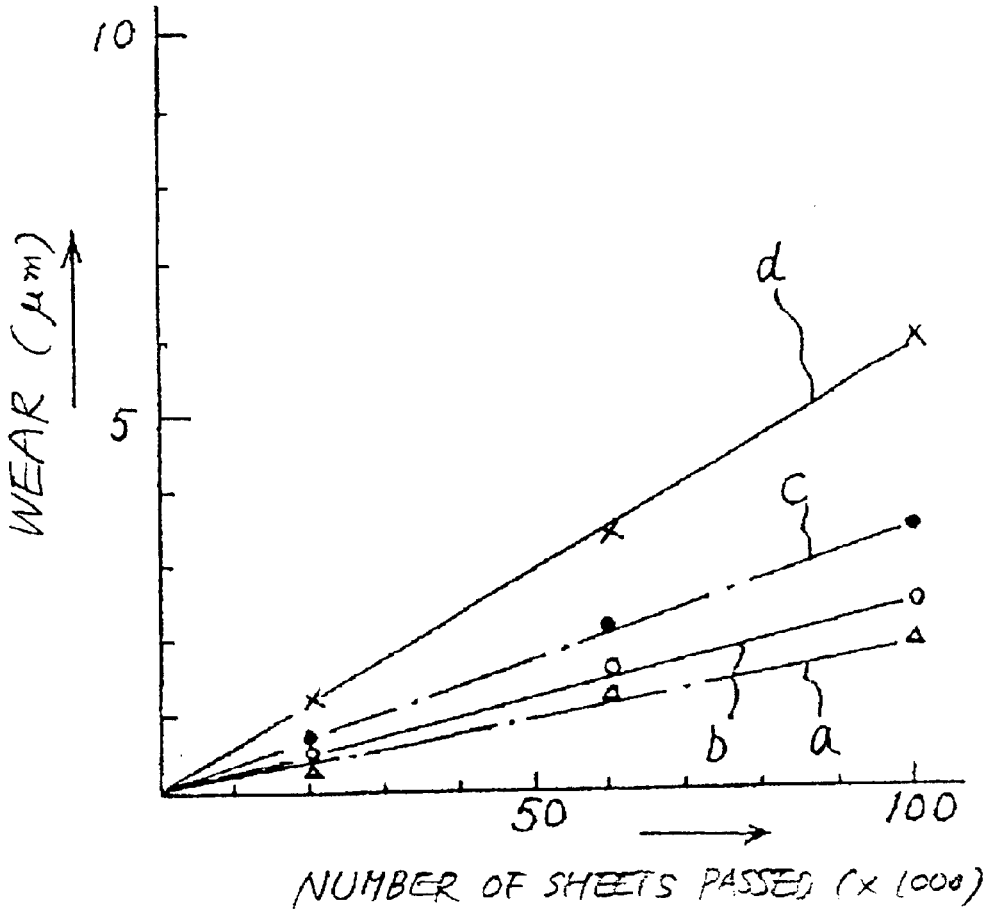
FIG. 18 is a graph showing a specific relation between the number of sheets passed and the wear of the surface of an image carrier.
Figure 19:
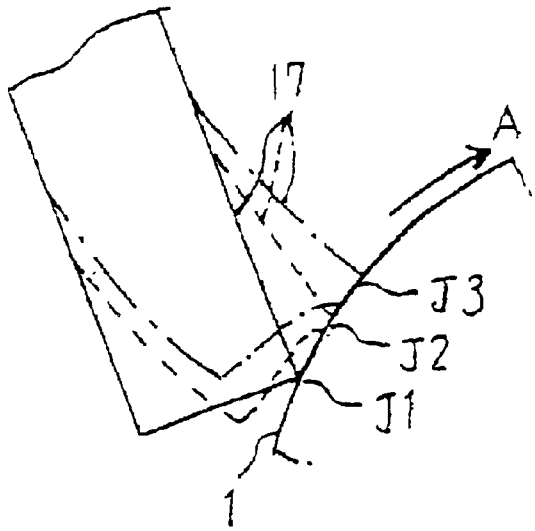
FIG. 19 is a fragmentary view showing the behavior of a cleaning blade.

FIG. 18 shows curves a, b, c and d representative of a relation between the number of sheets and the wear of the image carrier determined under the same conditions as in FIG. 17 except that the cleaning blade 17 was pressed against the image carrier. As FIG. 18 indicates, the wear of the image carrier varies with the same tendency as the coefficient of friction and sequentially increases in the order of the curves a, b, c and d. This is because, as shown in FIG. 19, the greater the coefficient of friction of the image carrier, the more the blade 17 is entrained by the surface of the image carrier 1 in the direction A and deformed. More specifically, as shown in FIG. 19, the deformation of the blade 17 increases in the order of lines J1, J2 and J3 when the coefficient of friction is high. An increase in the deformation of the blade 17 directly translates into an increase in linear pressure to act on the image carrier and therefore an increase in wear.

As stated above, the disfiguring substance deposited on the image carrier further reduces the life of the image carrier. Stated another way, the life of the image carrier can be extended if the disfiguring substance is removed from the image carrier.

Figure 20:
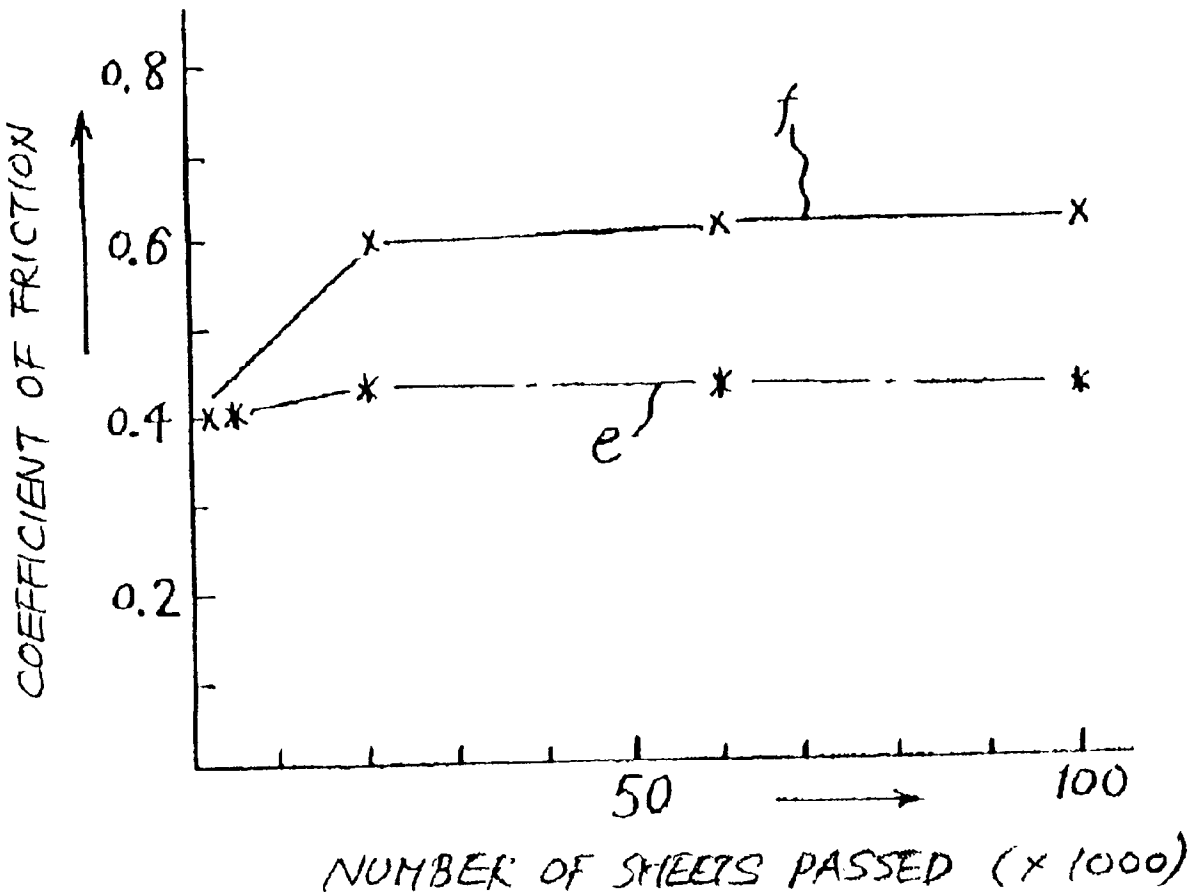
FIG. 20 is a graph showing another specific relation between the number of sheets passed and the coefficient of friction of the surface of an image carrier.

FIG. 20 shows a relation between the number of sheets and the coefficient of friction of the image carrier experimentally determined with the cleaning device not acting on the image carrier. For the experiments, the charge roller 20, FIG. 2, having a diameter of 14 mm was applied with AC voltage (sinusoidal wave, 1 kHz and 1.8 kvp-p (peak-to-peak)) plus DC voltage (−950 V). In FIG. 20, a curve e was obtained when the adsorbent support 19 shown in FIG. 9 was pressed against the image carrier, provided with compression deformation of 1 mm, and driven by the image carrier. A curve f was obtained when the absorbent support 19 was not used.

Figure 21:
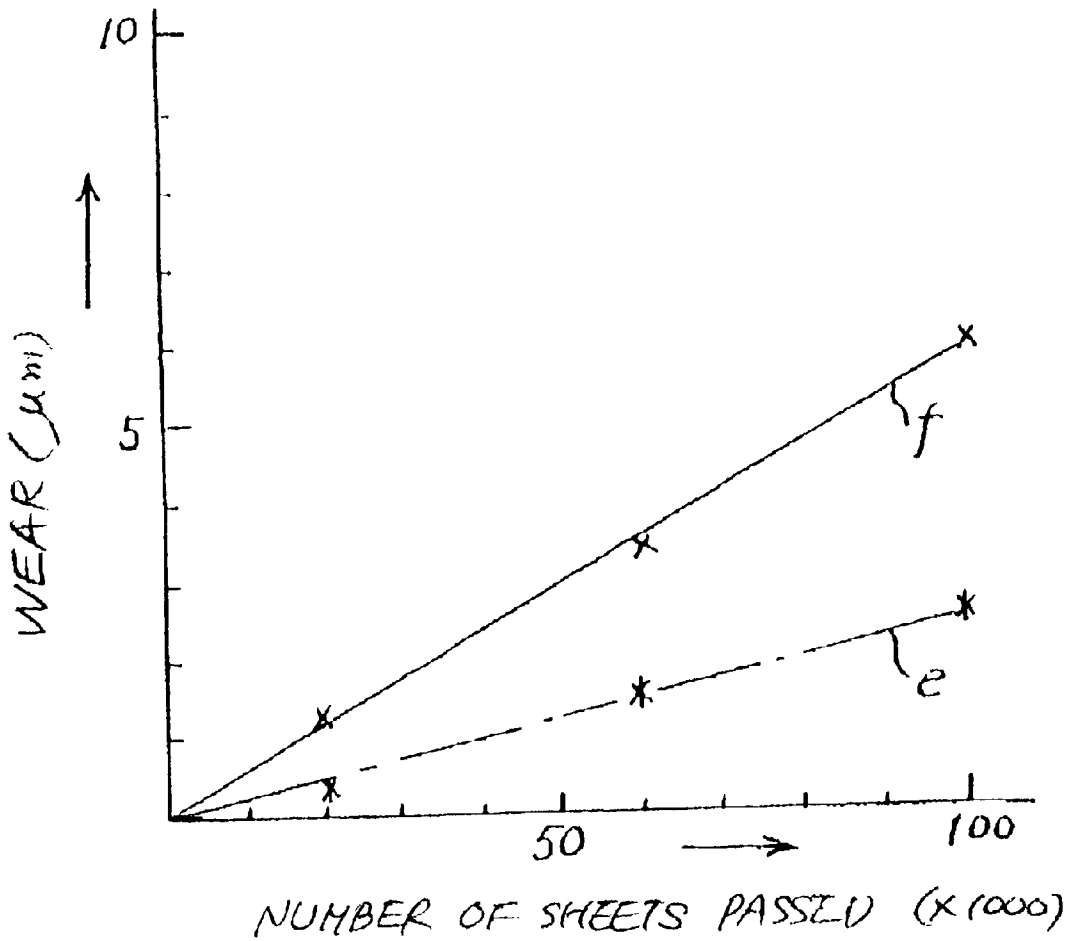
FIG. 21 is a graph showing another specific relation between the number of sheets passed and the wear of the surface of an image carrier.

FIG. 21 shows curves e and f representative of a relation between the number of sheets and the wear of the image carrier determined under the same conditions as in FIG. 20 except that the blade 17 was pressed against the image carrier. It will be seen that when zeolite affixed to the absorbent support 19 removes the disfiguring substance from the image carrier, the wear of the image carrier is almost halved. As for the curve e, images were free from defects even when 100,000 sheets were passed and when the wear of the image carrier was about 3 $\mu$m or less.

The image forming apparatus described above includes the disfiguring substance removing device and image carrier to contact the adsorbent carried on the adsorbent support. The adsorbent support 19 may be located at any desired position. However, the adsorbent support 19 should preferably be located at a position downstream, in the direction of rotation of the image carrier, of the position where the cleaning means contacts the image carrier for removing residual toner, but upstream of a position where the latent image forming means (laser writing unit 5) writs a latent image on the image carrier. This applies to all the configurations shown in FIGS. 1 through 5, FIG. 9, and FIGS. 11 through 16 and FIG. 16. The adsorbent support 19 located in such a position removes the disfiguring substance before a latent image is formed on the image carrier, thereby obviating defective images.

More preferably, the adsorbent support 19 should be located at a position downstream of a position where the charging device charges the image carrier, but upstream of the position where the latent image writing means writes a latent image on the image carrier. In this condition, part of the image carrier on which the disfiguring substance is present immediately arrives at the adsorbent support 19 and adsorbed thereby. This obviates defective images more positively.

Further, without regard to the position of the adsorbent support 19, the cleaning means contacts part of the image carrier whose coefficient of friction has been lowered due to the removal of the disfiguring substance. The cleaning means therefore causes the image carrier to wear little. Consequently, not only defective images are obviated, but also the wear of the image carrier is reduced.

Moreover, assume that the image carrier is formed of an amorphous silicon photoconductor. Then, the surface of the image carrier achieves hardness high enough to extend the life of the image carrier. In addition, the adsorbent removes the disfiguring substance from the image carrier to thereby obviate defective images. This is also true when the image carrier is implemented by a photoconductor having on its surface a layer in which, e.g., alumina powder of 0.1 $\mu$m or less is dispersed as a filer.

Further experimental results will be described hereinafter in order to prove the fact that the adsorbent support with zeolite effectively removes the disfiguring material from the image carrier. FIGS. 22 through 27 each show a specific arrangement used for experiments. In all the arrangements shown in FIGS. 22 through 27, the drum 1 had a diameter of 30 mm and an axial length of 340 mm. The drum 1 was continuously rotated over a period of time corresponding to 50,000 sheets of size A4 sequentially passed in the long edge feed position. After the rotation, the amount of ammonium nitrate deposited on the drum 1 was measured. It is to be noted that the amount of ammonium nitrate refers to the total amount of ammonium nitrate deposited on the entire circumferential surface of the drum 1.

Figure 22:
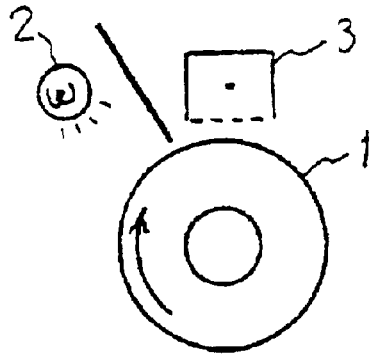
FIGS. 22 through 27 are views each showing a particular experimental arrangement.
Figure 23:
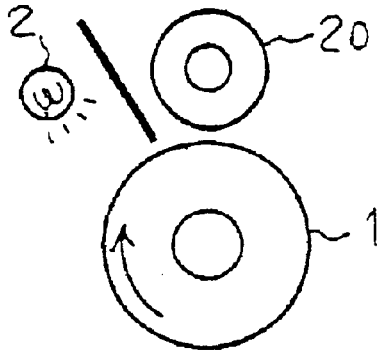

In the arrangement shown in FIG. 22, while the discharge lamp 2 discharged the image carrier, the charger 3 charged the surface of the drum 1. The arrangement of FIG. 23 is identical with the arrangement of FIG. 22 except that the charge roller 20 was substituted for the charger 3. In FIGS. 22 and 23, both the adsorbent support and cleaning member were not used. The amounts of ammonium nitrate measured in the conditions shown in FIGS. 22 and 23 will be represented by (1) and (2), respectively.

Figure 24:
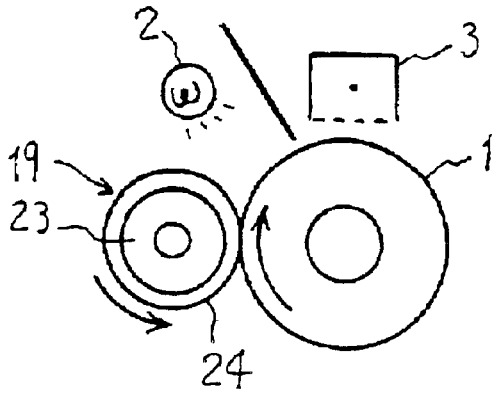
Figure 25:
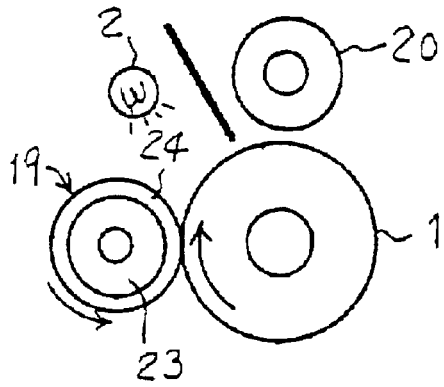

The arrangements shown in FIGS. 24 and 25 respectively correspond to the arrangements of FIGS. 22 and 23 except that the adsorbent support 19 with the surface layer 24 was held in contact with the drum 1. In this case, the adsorbent support 19 was rotated at a linear velocity 1.3 times as high as that of the drum 1 in a direction indicated by an arrow, thereby removing ammonium nitrate. The portion of the adsorbent support 19 contacting the drum 1 deformed by compression by 2 mm. The amounts of ammonium nitrate measured in the conditions shown in FIGS. 24 and 25 will be represented by (3) and (4), respectively.

Figure 26:
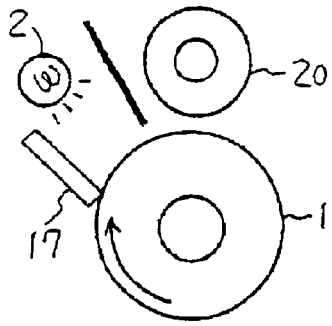
Figure 27:
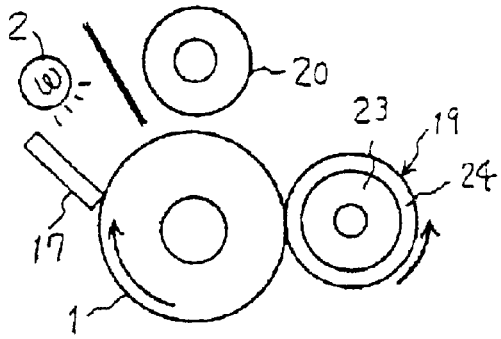

The arrangement shown in FIG. 26 is identical with the arrangement of FIG. 23 except that the blade 17 was pressed against the drum 1. The amount of ammonium nitrate measured in this condition will be represented by (5). Further, the arrangement shown in FIG. 27 is the combination of the arrangement of FIG. 26 and the adsorbent support 19 of FIGS. 24 and 25. The amount of ammonium nitrate measured in this condition will be represented by (6).

Figure 28:
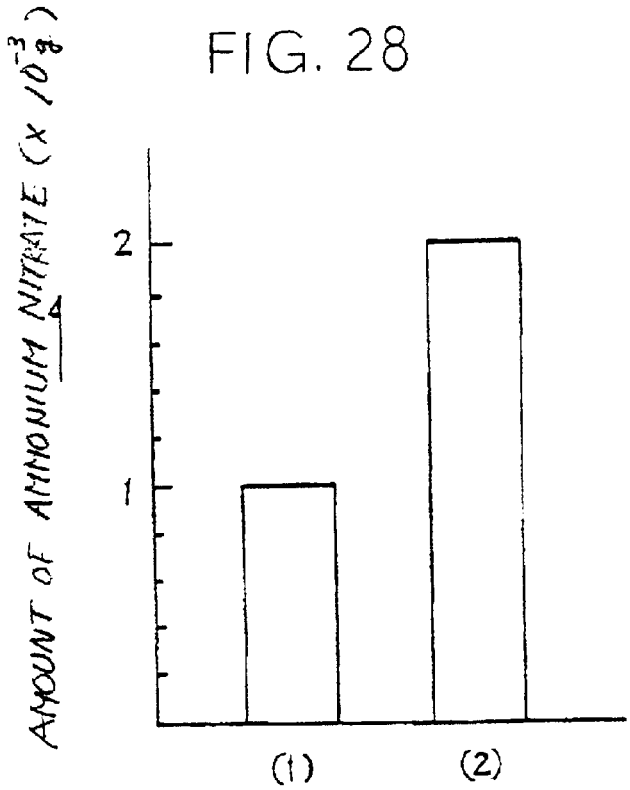
FIGS. 28 through 32 are graphs showing experimental results.
Figure 29:
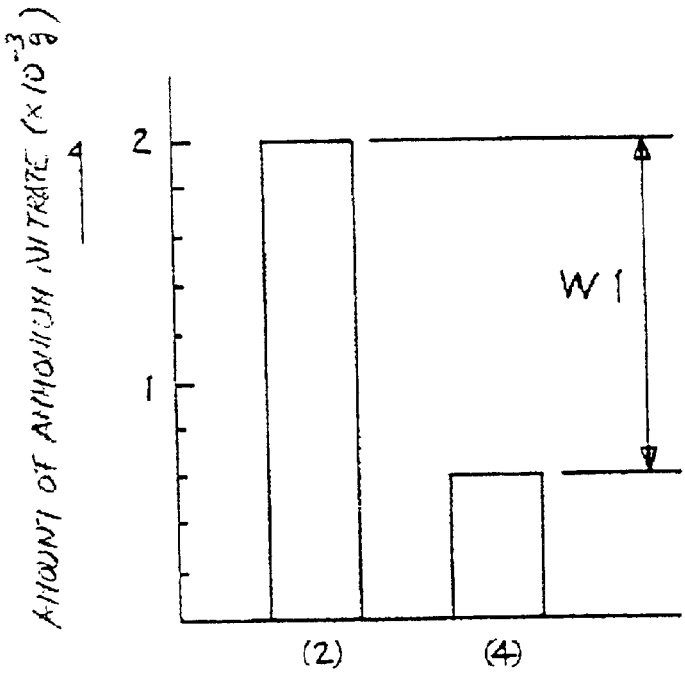

FIGS. 28 through 32 compare the amounts of ammonium nitrate (1) through (6) deposited on the drum 1. As shown in FIG. 28, the amount (2) measured in the condition of FIG. 23 (charge roller 20) is greater than the amount (1) measured in the condition of FIG. 22 (charger 3). In the case where the charge roller 20 is used, the amount (4) measured in the condition of FIG. 25 (zeolite) is smaller than the amount (2) (no zeolite) by W1. This decrease is presumably representative of the amount of ammonium nitrate removed by zeolite.

Figure 30:
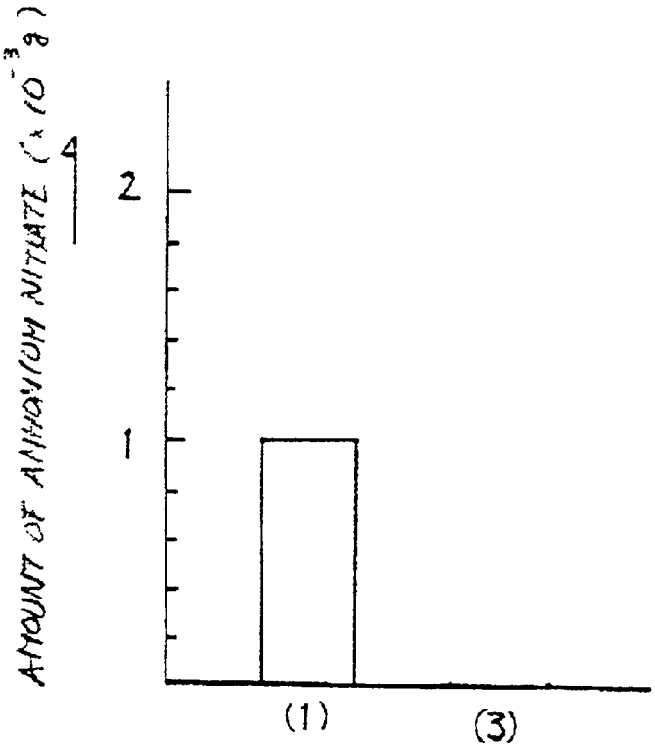

As shown in FIG. 30, the amount (3) means that when the charger 3 and zeolite are used (FIG. 24), substantially entire ammonium nitrate was removed.

Figure 31:
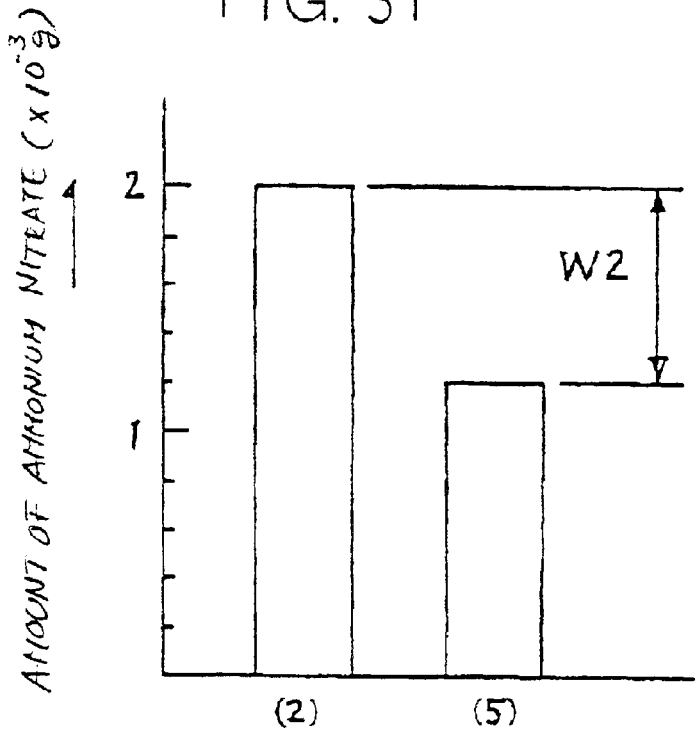
Figure 32:
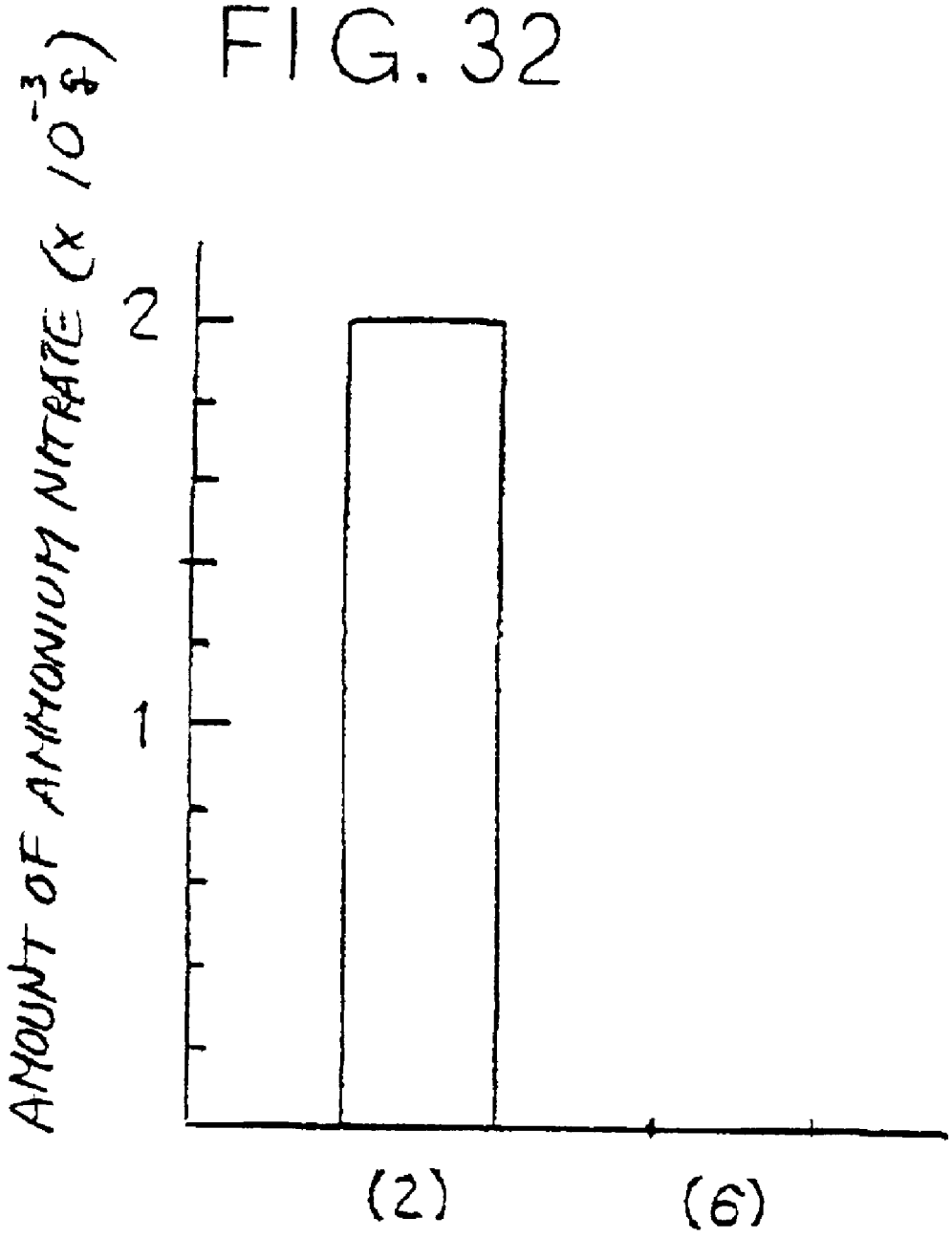

As shown in FIG. 31, the amount (5) measured in the condition shown in FIG. 26 (blade 17) is smaller than the amount (2) by W2. This decrease is presumably representative of the amount of ammonium nitrate removed by the blade 17. Further, as shown in FIG. 32, the amount (6) means that substantially entire ammonium nitrate was removed when the charge roller 20, zeolite and blade 17 were used in combination (FIG. 27).

The experimental results described with reference to FIGS. 28 through 32 also prove that the adsorbent can effectively remove the disfiguring substance from the image carrier.

The present invention is applicable to various image forming apparatuses including one that exposes a charged image carrier imagewise and deposits toner on a latent image higher in the absolute value of charge than a background, and one that forms a color image.

In summary, it will be seen that the present invention provides a disfiguring substance removing device capable of obviating or effectively reducing defective images ascribable to a disfiguring substance.

Various modifications will become possible for those skilled in the art after receiving the teachings of the present disclosure without departing from the scope thereof.

What is claimed is:

1. An image forming method for removing a substance from an image carrier that disfigures an image, wherein the method comprises, contacting an adsorbent with the image carrier, wherein the adsorbent has a molecular structure including voids that have a diameter great enough to pass molecules of said substance deposited on a surface of the image carrier through the adsorbent and wherein the voids may contain water.

2. A device for removing a substance that disfigures an image, said device comprising:

an adsorbent support supporting an adsorbent having a molecular structure including voids that have a diameter great enough to pass molecules of said substance and wherein the voids may contain water, wherein the substance is present on the surface of an image carrier.

3. The device as claimed in claim 2, wherein said adsorbent is affixed to said adsorbent support.

4. The device as claimed in claim 3, wherein said adsorbent comprises grains releasably carried on said adsorbent support.

5. The device as claimed in claim 4, wherein said adsorbent support includes an elastic body carrying said adsorbent.

6. The device as claimed in claim 5, wherein said adsorbent support is rotatable.

7. The device as claimed in claim 6, wherein said the voids of said adsorbent have a diameter great enough to pass molecules of ammonium nitrate.

8. The device as claimed in claim 7, wherein said adsorbent comprises zeolite.

9. The device as claimed in claim 8, wherein the molecular structure of zeolite has at least six oxygen rings.

10. The device as claimed in claim 8, wherein the molecular structure of zeolite has at least eight oxygen rings.

11. The device as claimed in claim 4, wherein said adsorbent support comprises an elastic body and a surface layer removably fitted on said elastic body, said adsorbent being carried on said surface layer.

12. The device as claimed in claim 4, wherein said adsorbent support comprises a brush having bristles on which said adsorbent is carried.

13. The device as claimed in claim 4, wherein said adsorbent support comprises an endless belt passed over a plurality of support members, said adsorbent being carried on a surface of said endless belt.

14. The device as claimed in claim 4, wherein said adsorbent support is rotatable.

15. The device as claimed in claim 3, wherein said adsorbent support includes an elastic body carrying said adsorbent.

16. The device as claimed in claim 3, wherein said adsorbent support comprises an elastic body and a surface layer removably fitted on said elastic body, said adsorbent being carried on said surface layer.

17. The device as claimed in claim 3, wherein said adsorbent support comprises a brush having bristles on which said adsorbent is carried.

18. The device as claimed in claim 3, wherein said adsorbent support comprises an endless belt passed over a plurality of support members, said adsorbent being carried on a surface of said endless belt.

19. The device as claimed in claim 3, wherein said adsorbent support is rotatable.

20. The device as claimed in claim 3, wherein said the voids of said adsorbent have a diameter great enough to pass molecules of ammonium nitrate.

21. The device as claimed in claim 20, wherein said adsorbent comprises zeolite.

22. The device as claimed in claim 21, wherein the molecular structure of zeolite has at least six oxygen rings.

23. The device as claimed in claim 21, wherein the molecular structure of zeolite has at least eight oxygen rings.

24. The device as claimed in claim 2, wherein said adsorbent comprises grains releasably carried on said adsorbent support.

25. The device as claimed in claim 24, wherein said adsorbent support includes an elastic body carrying said adsorbent.

26. The device as claimed in claim 25, wherein said adsorbent support is rotatable.

27. The device as claimed in claim 26, wherein said the voids of said adsorbent have a diameter great enough to pass molecules of ammonium nitrate.

28. The device as claimed in claim 27, wherein said adsorbent comprises zeolite.

29. The device as claimed in claim 28, wherein the molecular structure of zeolite has at least six oxygen rings.

30. The device as claimed in claim 28, wherein the molecular structure of zeolite has at least eight oxygen rings.

31. The device as claimed in claim 24, wherein said adsorbent support comprises an elastic body and a surface layer removably fitted on said elastic body, said adsorbent being carried on said surface layer.

32. The device as claimed in claim 24, wherein said adsorbent support comprises a brush having bristles on which said adsorbent is carried.

33. The device as claimed in claim 24, wherein said adsorbent support comprises an endless belt passed over a plurality of support members, said adsorbent being carried on a surface of said endless belt.

34. The device as claimed in claim 24, wherein said adsorbent support is rotatable.

35. The device as claimed in claim 2, wherein said adsorbent support includes an elastic body carrying said adsorbent.

36. The device as claimed in claim 35, wherein said adsorbent support is rotatable.

37. The device as claimed in claim 36, wherein said the voids of said adsorbent have a diameter great enough to pass molecules of ammonium nitrate.

38. The device as claimed in claim 37, wherein said adsorbent comprises zeolite.

39. The device as claimed in claim 38, wherein the molecular structure of zeolite has at least six oxygen rings.

40. The device as claimed in claim 38, wherein the molecular structure of zeolite has at least eight oxygen rings.

41. The device as claimed in claim 2, wherein said adsorbent support comprises an elastic body and a surface layer removably fitted on said elastic body, said adsorbent being carried on said surface layer.

42. The device as claimed in claim 41, wherein said adsorbent support is rotatable.

43. The device as claimed in claim 42, wherein said the voids of said adsorbent have a diameter great enough to pass molecules of ammonium nitrate.

44. The device as claimed in claim 43, wherein said adsorbent comprises zeolite.

45. The device as claimed in claim 44, wherein the molecular structure of zeolite has at least six oxygen rings.

46. The device as claimed in claim 44, wherein the molecular structure of zeolite has at least eight oxygen rings.

47. The device as claimed in claim 2, wherein said adsorbent support comprises a brush having bristles on which said adsorbent is carried.

48. The device as claimed in claim 47, wherein said adsorbent support is rotatable.

49. The device as claimed in claim 48, wherein said the voids of said adsorbent have a diameter great enough to pass molecules of ammonium nitrate.

50. The device as claimed in claim 49, wherein said adsorbent comprises zeolite.

51. The device as claimed in claim 50, wherein the molecular structure of zeolite has at least six oxygen rings.

52. The device as claimed in claim 50, wherein the molecular structure of zeolite has at least eight oxygen rings.

53. The device as claimed in claim 2, wherein said adsorbent support comprises an endless belt passed over a plurality of support members, said adsorbent being carried on a surface of said endless belt.

54. The device as claimed in claim 53, wherein said adsorbent support is rotatable.

55. The device as claimed in claim 54, wherein said the voids of said adsorbent have a diameter great enough to pass molecules of ammonium nitrate.

56. The device as claimed in claim 55, wherein said adsorbent comprises zeolite.

57. The device as claimed in claim 56, wherein the molecular structure of zeolite has at least six oxygen rings.

58. The device as claimed in claim 56, wherein the molecular structure of zeolite has at least eight oxygen rings.

59. The device as claimed in claim 2, wherein said adsorbent support is rotatable.

60. The device as claimed in claim 59, wherein said the voids of said adsorbent have a diameter great enough to pass molecules of ammonium nitrate.

61. The device as claimed in claim 60, wherein said adsorbent comprises zeolite.

62. The device as claimed in claim 61, wherein the molecular structure of zeolite has at least six oxygen rings.

63. The device as claimed in claim 61, wherein the molecular structure of zeolite has at least eight oxygen rings.

64. The device as claimed in claim 2, wherein said the voids of said adsorbent have a diameter great enough to pass molecules of ammonium nitrate.

65. The device as claimed in claim 64, wherein said adsorbent comprises zeolite.

66. The device as claimed in claim 65, wherein the molecular structure of zeolite has at least six oxygen rings.

67. The device as claimed in claim 65, wherein the molecular structure of zeolite has at least eight oxygen rings.

68. The device as claimed in claim 2, wherein said adsorbent comprises zeolite.

69. The device as claimed in claim 68, wherein the molecular structure of zeolite has at least six oxygen rings.

70. The device as claimed in claim 68, wherein the molecular structure of zeolite has at least eight oxygen rings.

71. A process cartridge including a device for removing a substance that disfigures an image, said device comprising:

an adsorbent support supporting an adsorbent having a molecular structure including voids that have a diameter great enough to pass molecules of said substance deposited on a surface of an image carrier, through the adsorbent and wherein the voids may contain water.

72. An image forming apparatus comprising:

a device for removing a substance that disfigures an image; and an image carrier configured to form an image thereon; said device comprising:

an adsorbent support supporting an adsorbent having a molecular structure including voids that have a diameter great enough to pass molecules of said substance through the adsorbent and wherein the voids may contain water, wherein the substance is present on the surface of an image carrier.

73. The apparatus as claimed in claim 72, wherein said adsorbent support is rotatable by being driven by said image carrier.

74. The apparatus as claimed in claim 73, wherein said adsorbent support contacts said image carrier at a position downstream, in a direction in which the surface of said image carrier moves, of a position where cleaning means for removing toner left on said image carrier after image transfer contacts said image carrier, but upstream of a position where latent image forming means writes a latent image on said image carrier.

75. The apparatus as claimed in claim 74, wherein said adsorbent support contacts said image carrier at a position downstream, in said direction, of a position where a charging device uniformly charges said image carrier, but upstream of the position where said latent image forming means writes a latent image on said image carrier.

76. The apparatus as claimed in claim 75, wherein said image carrier comprises an amorphous silicon photoconductor.

77. The apparatus as claimed in claim 75, wherein said image carrier comprises a photoconductor having a surface layer in which a filler is dispersed.

78. The apparatus as claimed in claim 72, wherein said adsorbent support and said image carrier each move at a particular linear velocity.

79. The apparatus as claimed in claim 78, wherein said adsorbent support contacts said image carrier at a position downstream, in a direction in which the surface of said image carrier moves, of a position where cleaning means for removing toner left on said image carrier after image transfer contacts said image carrier, but upstream of a position where latent image forming means writes a latent image on said image carrier.

80. The apparatus as claimed in claim 79, wherein said adsorbent support contacts said image carrier at a position downstream, in said direction, of a position where a charging device uniformly charges said image carrier, but upstream of the position where said latent image forming means writes a latent image on said image carrier.

81. The apparatus as claimed in claim 80, wherein said image carrier comprises an amorphous silicon photoconductor.

82. The apparatus as claimed in claim 80, wherein said image carrier comprises a photoconductor having a surface layer in which a filler is dispersed.

83. The apparatus as claimed in claim 72, wherein said adsorbent support contacts said image carrier at a position downstream, in a direction in which the surface of said image carrier moves, of a position where cleaning means for removing toner left on said image carrier after image transfer contacts said image carrier, but upstream of a position where latent image forming means writes a latent image on said image carrier.

84. The apparatus as claimed in claim 83, wherein said adsorbent support contacts said image carrier at a position downstream, in said direction, of a position where a charging device uniformly charges said image carrier, but upstream of the position where said latent image forming means writes a latent image on said image carrier.

85. The apparatus as claimed in claim 84, wherein said image carrier comprises an amorphous silicon photoconductor.

86. The apparatus as claimed in claim 84, wherein said image carrier comprises a photoconductor having a surface layer in which a filler is dispersed.

87. The apparatus as claimed in claim 72, wherein said adsorbent support contacts said image carrier at a position downstream of a position where a charging device uniformly charges said image carrier, but upstream of the position where a latent image forming means writes a latent image on said image carrier.

88. The apparatus as claimed in claim 87, wherein said image carrier comprises an amorphous silicon photoconductor.

89. The apparatus as claimed in claim 87, wherein said image carrier comprises a photoconductor having a surface layer in which a filler is dispersed.

90. The apparatus as claimed in claim 72, wherein said image carrier comprises a photoconductor having a surface layer in which a filler is dispersed.

* * * * *